US008347520B2

(12) United States Patent
Kuwabara

(10) Patent No.: US 8,347,520 B2
(45) Date of Patent: Jan. 8, 2013

(54) DRYING UNIT AND LAUNDRY WASHING/DRYING MACHINE EQUIPPED WITH THE DRYING UNIT

(75) Inventor: Osamu Kuwabara, Gunma (JP)

(73) Assignee: Sanyo Electric Co., Ltd., Moriguchi-Shi, Osaka-Fu (JP)

( * ) Notice: Subject to any disclaimer, the term of this patent is extended or adjusted under 35 U.S.C. 154(b) by 396 days.

(21) Appl. No.: 12/079,750

(22) Filed: Mar. 28, 2008

(65) Prior Publication Data

US 2008/0235977 A1 Oct. 2, 2008

(30) Foreign Application Priority Data

Mar. 30, 2007 (JP) ..... 2007-091233

(51) Int. Cl.
*F26B 21/08* (2006.01)

(52) U.S. Cl. ..... 34/73; 34/77; 34/78; 34/596; 34/134

(58) Field of Classification Search ..... 34/72, 73, 34/76, 77, 78, 86, 596, 134; 62/197, 198, 62/210, 525
See application file for complete search history.

(56) References Cited

U.S. PATENT DOCUMENTS

| | | | | |
|---|---|---|---|---|
| 6,775,998 | B2 * | 8/2004 | Yuasa et al. | 62/197 |
| 6,938,356 | B2 * | 9/2005 | Nagae et al. | 34/77 |
| 7,055,262 | B2 * | 6/2006 | Goldberg et al. | 34/86 |

FOREIGN PATENT DOCUMENTS

| | | | |
|---|---|---|---|
| DE | 4409607 | A1 * | 10/1994 |
| EP | 0 716 178 | A2 | 6/1996 |
| EP | 1 593 770 | A2 | 11/2005 |
| JP | 2004-229954 | | 8/2004 |

* cited by examiner

*Primary Examiner* — Jiping Lu
(74) *Attorney, Agent, or Firm* — Weingarten, Schurgin, Gagnebin & Lebovici LLP

(57) ABSTRACT

In a laundry washing/drying machine involving drying by a heat pump cycle, in an initial stage of the drying operation the heat within an air circulation path is deficient and therefore it is impossible to effect quick heating of air on a drum inlet side up to a sufficiently high temperature. According to the present invention there is provided a drying unit capable of raising the drum inlet air temperature quickly up to a sufficiently high temperature in an initial stage of the drying operation and thereby shortening the drying time. The drying unit includes a heat pump cycle device for performing a cycle of radiating, with use of a radiator, the heat of a refrigerant compressed by a compressor, passing the refrigerant through a pressure reducing/expansion valve, evaporating the refrigerant in an evaporator and compressing the refrigerant again by the compressor, an air circulation path for allowing air to be circulated by a blower in such a manner that air heated by the radiator is introduced into a drying chamber to dry the laundry, exhaust air discharged from the drying chamber is passed through the evaporator, then is heated again by the radiator and the air thus dehumidified is circulated by the blower, and an external heat source applying device for applying the heat of an external heat source to the evaporator to quicken the rise in temperature of the air in an initial stage of the drying operation.

12 Claims, 7 Drawing Sheets

| | Drying Operation (Drying Process) | | |
|---|---|---|---|
| | Initial Stage (Rise) | Middle Stage (Normal Operation) | Latter Stage (Heating Water in Water Storage Tank) |
| Opening/Closing Valve (47) | Close | Open | Close |
| Opening/Closing Valve (48) | Close | Close | Open |

*FIG. 6*

| | Drying Operation (Drying Process) | | |
|---|---|---|---|
| | Initial Stage (Rise) | Middle Stage (Normal Operation) | Latter Stage (Heating Water in Water Storage Tank) |
| Opening/Closing Valve (47) | Close | Open | Close |
| Pressure Reducing/ Expansion Valve (32) | Fully Open (Without throttling operation) | Throttling Operation | Throttling Operation |
| Pressure Reducing/ Expansion Valve (54A) | Throttling Operation | Closed or Largely Throttled | Fully Open (Without throttling operation) |

*FIG. 7*

DRYING UNIT AND LAUNDRY WASHING/DRYING MACHINE EQUIPPED WITH THE DRYING UNIT

This application claims priority to Japanese application No. 2007-091233 filed Mar. 30, 2007.

BACKGROUND OF THE INVENTION

1. Field of the Invention

The present invention relates to a drying unit comprising a heat pump cycle device and an air circulation path, the heat pump cycle device performing a cycle of radiating, with use of a radiator, the heat of a refrigerant compressed by a compressor, then allowing the refrigerant to pass through a pressuring reducing/expansion unit and be evaporated by an evaporator, then compressing the refrigerant again by the compressor, the air circulation path allowing air to be circulated by a blower in such a manner that the air heated by the radiator is introduced into a drying chamber to dry the laundry, then the air exhausted from the drying chamber is dehumidified by the evaporator and is thereafter heated again by the radiator, as well as a laundry washing/drying machine equipped with the drying unit.

2. Description of the Prior Art

There is known a laundry washing/drying machine equipped with a drying unit, the drying unit comprising a heat pump cycle device and an air circulation path, the heat pump cycle device performing a cycle of radiating, with use of a radiator, the heat of a refrigerant compressed by a compressor, then allowing the refrigerant to pass through a pressure reducing/expansion device and be evaporated by an evaporator, then compressing the refrigerant again by the compressor, the air circulation path allowing air to be circulated by a blower in such a manner that the air heated by the radiator is introduced into a drying chamber to dry the laundry, the air exhausted from the drying chamber is dehumidified by the evaporator and is thereafter heated again by the radiator. (See, for example, Japanese Patent Laid-Open Publication No. 2004-229954.)

SUMMARY OF THE INVENTION

In the laundry washing/drying machine described in the above-mentioned Patent Literature, the laundry is put into a drum and is washed by oscillation of the drum, then is spin-dried and is thereafter dried by a drying unit within the drum. As the drying unit there is used a heat pump type drying unit, the heat pump type drying unit including a compressor for compressing a refrigerant, a high temperature-side heat exchanger for heating air with heat of the compressed refrigerant, an expansion valve for expanding the refrigerant leaving the high temperature-side heat exchanger, and a low-temperature side heat exchanger for heat-exchanging the refrigerant leaving the expansion valve with the air leaving the drum, thereby condensing and dehumidifying the refrigerant. In this laundry washing/drying machine, according to the description of the above-mentioned Patent Literature, both heating the air entering the drum and dehumidifying the air leaving the drum can be done efficiently by using a carbon dioxide refrigerant as the refrigerant.

Thus, the laundry is put into the drum, then is washed, spin-dried and dried within the drum. In this connection, if it is assumed that the drying is carried out by performing a heat pump cycle, then in an initial stage of the drying operation or in an initial stage of the drying process (i.e., in an initial stage during the drying operation time such as during several minutes after the start of the drying operation), the air temperature in an outlet of the drum corresponds substantially to an ambient temperature of the laundry washing/drying machine (approximately the room temperature of about 20° C. to 30° C. in case of the laundry washing/drying machine being installed indoors) and heat pump operation is performed using the drum outlet air as a heat source. However, in an initial state of the drying operation (in an initial stage of the drying process), the drum inlet air temperature cannot be raised quickly to a sufficiently high temperature (e.g. 70° C. or so) because the heat within the air circulation path is deficient.

According to this heat pump cycle, heat corresponding to electric power supplied into the compressor with continuation of operation is accumulated in each of an air circulation duct, water contained in the laundry within the drum and the compressor, with the result that their temperatures rise gradually and so does the temperature of the drum outlet air. With such an operation, the temperature and humidity, i.e., specific enthalpy, of the drum outlet air increase and it becomes possible to obtain a heating capacity sufficient to heat the drum inlet air up to a desired high temperature (e.g. 70° C. or so).

Thus, when performing the heat pump cycle to effect drying, in an initial stage of the drying operation (in the initial stage of the drying process) the heat within the air circulation path is deficient and it is impossible to heat the drum inlet air quickly up to a sufficiently high temperature (e.g. 70° C. or so), taking a considerable time (e.g. 10 minutes) for heating up to such a sufficiently high temperature (e.g. 70° C.).

If much heat is drawn up from the drum outlet air, the air outlet-side temperature of the low temperature-side heat exchanger (evaporator) in the heat pump cycle (or the refrigerant inlet-side temperature in the case where the evaporator is of a construction wherein a refrigerant inlet pipe is disposed on an air outlet side and a refrigerant outlet pipe is disposed on an air inlet side) falls and a large heating capacity is required for increasing the temperature of air entering the drum, thus giving rise to the problem that the compressor for compressing the refrigerant used in the heat pump cycle is required to have a large capacity.

According to the present invention, in view of the above-mentioned points, there is provided a laundry drying unit capable of quickening the rise in temperature of the drum inlet air in an initial stage of the drying operation (in an initial stage of the drying process) to effect heating quickly up to a sufficiently high temperature (e.g. 70° C. or so) and thereby shortening the drying time.

To this end there is adopted a method wherein a refrigerant evaporating function section draws up heat from an external heat source in an initial stage of the drying operation (in an initial stage of the drying process) to promote heating of the circulation air by the radiator in the heat pump cycle. More specifically, according to a first method the external heat source is ambient air and according to a second method the external heat source is water or antifreeze solution stored in a tank.

As one example of the second method there may be adopted a method wherein, in a laundry washing machine for washing, rinsing and drying the laundry, water (called rinsing water) used in a preceding rinsing process is stored in a tank and this stored water (washing water) is used in the next washing process. In addition there may be adopted a method wherein the heat of the said water (washing water) is applied as an external heat source to the refrigerant evaporating function section in the heat pump cycle. By adopting these methods there is provided a laundry washing/drying machine wherein the rise in temperature of the drum inlet air is quickened in an initial stage of the drying operation (in an initial stage of the drying process) to quicken the rise until reaching a predetermined drying temperature (i.e., shorten the rise time), while at the end of the drying operation the water (washing water) stored in the tank is brought into a state of hot water so as to be employable as washing water in the next washing operation, thus making it possible to ensure the removal of laundry stains in the next washing.

In a first aspect of the present invention there is provided a drying unit comprising a heat pump cycle device performing a cycle of radiating, with use of a radiator, the heat of a refrigerant compressed by a compressor, then passing the refrigerant through a pressure reducing/expansion valve, evaporating the refrigerant by an evaporator and compressing the refrigerant again by the compressor, an air circulation path for allowing air to be circulated by a blower in such a manner that air heated by the radiator is introduced into a drying chamber to dry the laundry, exhaust air discharged from the drying chamber is passed through the evaporator, then is heated again by the radiator and the air thus dehumidified is circulated by the blower, and an external heat source applying device for applying the heat of an external heat source to the evaporator to quicken the rise in temperature of the air in an initial stage of the drying operation (in an initial stage of the drying process).

In a second aspect of the present invention there is provided, in combination with the above first aspect, a drying unit wherein the external heat source applying device comprises, for using ambient air as the external heat source, an air intake port for introducing ambient air so as to join the air circulating through the air circulation path, the air intake port being formed in an air path portion located between the drying chamber and the evaporator in the air circulation path, and an air discharge port for discharging a portion of the air circulating through the air circulation path to the environs, the air discharge port being formed in an air path portion located between the evaporator and the radiator in the air circulation path.

In a third aspect of the present invention there is provided, in combination with the above second aspect, a drying unit wherein an opening/closing mechanism is disposed in one or both of the air intake port and the air discharge port, the opening and closing of the opening/closing mechanism being controlled on the basis of specific enthalpies calculated from outlet-side temperature and humidity of the air in the evaporator and the temperature and humidity of the ambient air.

In a fourth aspect of the present invention there is provided, in combination with the above second aspect, a drying unit wherein the evaporator is in a shape such that air passages are formed each between adjacent ones of many juxtaposed plate-like fins and a meandering refrigerant pipe extends through the many plate-like fins, and in the evaporator, a refrigerant inlet-side pipe is disposed on the air outlet side, a refrigerant outlet-side pipe is disposed on the air inlet side, and the opening and closing of one or both of the air intake port and the air discharge port are controlled on the basis of specific enthalpies, the specific enthalpies being calculated on the basis of detections made by temperature and humidity sensors for detecting the air temperature and humidity respectively on the air outlet side of the evaporator or the temperature and humidity respectively of the refrigerant inlet-side pipe and temperature and humidity sensors for detecting the temperature and humidity respectively of the ambient air.

In a fifth aspect of the present invention there is provided a drying unit comprising a heat pump cycle device performing a cycle of radiating, with use of a radiator, the heat of a refrigerant compressed by a compressor, then passing the refrigerant through a pressure reducing/expansion device and an auxiliary heat exchanger, thereafter passing the refrigerant through a pressure reducing/expansion valve and an evaporator in this order and compressing the refrigerant again by the compressor, an air circulation path for allowing air to be circulated by a blower in such a manner that air heated by the radiator is introduced into a drying chamber to dry the laundry, exhaust air discharged from the drying chamber is dehumidified in the evaporator and is heated again by the radiator, and an external heat source applying device for allowing the refrigerant passing through the auxiliary heat exchanger to be heat-exchanged with an external heat source so as to quicken the rise in temperature of the air in an initial stage of the drying operation (in an initial stage of the drying process).

In a sixth aspect of the present invention there is provided, in combination with the above fifth aspect, a drying unit wherein the auxiliary heat exchanger is disposed within ambient air present outside the air circulation path, and a blower for forcibly heat-exchanging the auxiliary heat exchanger with ambient air is used as the external heat source applying device.

In a seventh aspect of the present invention there is provided, in combination with the above fifth aspect, a drying unit wherein as the external heat source applying device there is used an antifreeze solution tank for heat exchange of the refrigerant passing through the auxiliary heat exchanger with an antifreeze solution stored in the tank.

In an eighth aspect of the present invention there is provided, in a laundry washing machine wherein a laundry drying chamber is formed within a rotary drum, and with rotation of the rotary drum, the laundry is washed, rinsed with rinsing water and spin-dried within the rotary drum, followed by a drying operation (drying process) within the rotary drum, a drying unit comprising a water storage tank for storage of the rinsing water, a heat pump cycle device and an air circulation path, the heat pump cycle device performing a cycle of radiating, with use of a radiator, the heat of a refrigerant compressed by a compressor, then passing the refrigerant through a pressure reducing/expansion device and an auxiliary heat exchanger, thereafter passing the refrigerant through a pressure reducing/expansion valve and an evaporator in this order and compressing the refrigerant again by the compressor, the air circulation path allowing air to be circulated by a blower in such a manner that air heated by the radiator is introduced into the rotary drum to dry the laundry, exhaust air discharged from the rotary drum is passed through the evaporator, then is heated again by the radiator and the air thus dehumidified is circulated by the blower, the auxiliary heat exchanger being constructed so as to be heat-exchanged with the water stored in the water storage tank in order to quicken the rise in temperature of the air in an initial stage of the drying operation (in an initial stage of the drying process).

In a ninth aspect of the present invention there is provided, in combination with any of the above fifth to eighth aspects, a drying unit wherein a refrigerant passage is controlled by an opening/closing valve or by a change-over valve in such a manner that in an initial stage of the drying operation (in an initial stage of the drying process) the refrigerant leaving the radiator passes through the pressure reducing/expansion device and the auxiliary heat exchanger, thereafter flows from the pressure reducing/expansion valve to the evaporator, then in a middle stage of the drying operation (drying process) the refrigerant leaving the radiator bypasses the pressure reducing/expansion device and the auxiliary heat exchanger, passes through the pressure reducing/expansion valve and flows to the evaporator, and in a latter stage of the drying operation (drying process) the refrigerant leaving the radiator passes a substantial pressure reducing/expanding action induced by the pressure reducing/expansion device (bypasses the pressure reducing/expansion device or an expansion valve is fully opened in the case where the pressure reducing/expansion device is the expansion valve) and radiates heat in the auxiliary heat exchanger.

In a tenth aspect of the present invention there is provided, in a laundry machine wherein a laundry drying chamber is formed within a rotary drum, and with rotation of the rotary drum, the laundry is washed, rinsed with rinsing water and spin-dried within the rotary drum, followed by a drying operation (drying process) within the rotary drum, a drying unit comprising a water storage tank for storage of the rinsing water, a heat pump cycle device and an air circulation path, the heat pump cycle device performing a cycle of radiating, with use of a radiator, the heat of a refrigerant compressed by a compressor, then passing the refrigerant through a pressure reducing/expansion device and an auxiliary heat exchanger, thereafter passing the refrigerant through a pressure reducing/expansion valve and an evaporator in this order and compressing the refrigerant again by the compressor, the air circulation path allowing air to be circulated by a blower in such a manner that air heated by the radiator is introduced into the drying chamber to dry the laundry, exhaust air discharged from the drying chamber is passed through the evaporator, then is heated again by the radiator and the air thus dehumidified is circulated by the blower, wherein in an initial stage of the drying operation (in an initial stage of the drying process) the auxiliary heat exchanger is heat-exchanged with the water stored in the water storage tank so as to quicken the rise in temperature of the air, and in a later stage of the drying operation (drying process) the refrigerant leaving the radiator passes a substantial pressure reducing and expanding action induced by the pressure reducing/expansion device (bypasses the pressure reducing/expansion device or an expansion valve is fully opened in the case where the pressure reducing/expansion device is the expansion valve) and radiates heat in the auxiliary heat exchanger to heat the water stored in the water storage tank.

In an eleventh aspect of the present invention there is provided a laundry washing/drying machine comprising the drying unit described in any of the above first to tenth aspects wherein there is adopted a cooling-down process involving turning OFF of said heat pump cycle device and turning ON of said blower to cool the laundry just after termination of the drying operation (drying process).

According to the above first aspect of the present invention, since the external heat source applying device for applying the heat of an external heat source to the evaporator installed within the air circulation path is provided to quicken the rise in temperature of the circulating air in an initial stage of the drying operation (drying process), the temperature of the air leaving the evaporator rises as the evaporator draws up the heat of the external heat source and hence the rise in temperature of the radiator is quickened. Consequently, in case of performing the laundry drying operation (drying process) by the heat pump cycle device, it is possible to increase the speed of temperature rise in an initial stage of the drying operation (drying process) (e.g. for about 20 minutes after start of the drying operation, assuming that the drying operation time is 90 minutes) and hence it is possible to shorten the time of the drying operation (drying process). Besides, the power consumption in the drying operation (drying process) performed by the heat pump cycle device, etc. is reduced.

According to the above second aspect of the present invention, ambient air is admitted into the evaporator and is subjected to heat exchange, then a portion of the air is discharged to the environs until reaching the radiator after leaving the evaporator, whereby not only the ambient air can be utilized as the external heat source but also the temperature of the air leaving the evaporator and reaching the radiator can be increased, with the result that the rise in temperature of the radiator is quickened. Consequently, in case of performing the laundry drying operation (drying process) by the heat pump cycle device, it is possible to increase the speed of temperature rise in an initial stage of the drying operation (drying process) (e.g. for 20 minutes after start of the drying operation, assuming that the drying operation time is 90 minutes), whereby not only it is possible to shorten the time of the drying operation (drying process) but also the desired object can be achieved with a simple device. Besides, the power consumption in the drying operation (drying process) performed by the heat pump cycle device is reduced.

According to the above third aspect of the present invention, in addition to the effect of the above second aspect, the period of the effect attained by the introduction of ambient air can be controlled accurately by controlling ON-OFF of the opening/closing mechanism on the basis of specific enthalpies calculated from outlet-side temperature and humidity of the air in the evaporator and the temperature and humidity of the ambient air, the opening/closing mechanism being disposed in one or both of the air intake port and the air discharge port.

According to the above fourth aspect of the present invention, the layout of a refrigerant pipe in the evaporator is limited and specific enthalpies are calculated on the basis of detections made by temperature and humidity sensors for detecting the air temperature and humidity respectively on the air outlet side of the evaporator or the temperature and humidity respectively of a refrigerant inlet-side pipe and temperature and humidity sensors for detecting the temperature and humidity respectively of the ambient air, then the opening and closing of one or both of the air intake port and the air discharge port are controlled on the basis of the specific enthalpy, whereby it is possible to obtain the same effect as that obtained in the above second aspect.

According to the above fifth aspect of the present invention, the heat pump cycle device constitutes a refrigerant circuit so that the refrigerant leaving the radiator passes through the pressure reducing/expansion device and the auxiliary heat exchanger, and an external heat source applying device is provided so that the refrigerant passing through the auxiliary heat exchanger is heat-exchanged with an external heat source, whereby the circulation air cooling capacity of the evaporator installed within the air circulation path is deteriorated. Consequently, the air temperature at the evaporator outlet, i.e., at the radiator inlet, rises and so does the air temperature at the radiator outlet. As a result, the rise in temperature of the radiator in an initial stage of the drying operation (drying process) (e.g. for 20 minutes after start of the drying operation) is quickened. Therefore, in case of performing the laundry drying operation (drying process) by the heat pump cycle device, it is possible to increase the speed of temperature rise of the circulation air in the initial stage of the drying operation (drying process) and hence possible to shorten the time of the drying operation (drying process). Moreover, the power consumption in the drying operation (drying process) performed by the heat pump cycle device, etc. is also reduced.

According to the above sixth aspect of the present invention, since the auxiliary heat exchanger is forcibly heat-exchanged with the ambient air present outside the air circulation path by the blower, not only the same effect as in the above fifth aspect is attained but also the desired object can be achieved by the addition of a simple device.

According to the above seventh aspect of the present invention, the auxiliary heat exchanger is heat-exchanged with the antifreeze solution stored in the antifreeze solution tank, whereby not only the same effect as in the above fifth aspect is attained but also the desired object can be achieved by the addition of a simple device.

According to the above eighth aspect of the present invention, in a laundry washing machine wherein washing, rinsing, spin-drying and drying operation (drying process) of the laundry are performed within a rotary drum, rinsing water is stored in a water storage tank. Moreover, the heat pump cycle device constitutes a refrigerant circuit so that the refrigerant leaving the radiator passes through both pressure reducing/expansion device and auxiliary heat exchanger and this auxiliary heat exchanger undergoes heat exchange with the water stored in the water storage tank, whereby the circulation air cooling capacity of the evaporator installed within the air circulation path is deteriorated. Consequently, the air temperature at the evaporator outlet, i.e., at the radiator inlet, rises and so does the air temperature at the radiator outlet. As a result, in case of performing the laundry drying operation (drying process) by the heat pump cycle device, it is possible to increase the speed of temperature rise of the circulation air in an initial stage of the drying operation (drying process) (e.g. for 20 minutes after start of the drying operation) and hence possible to shorten the time of the drying operation (drying process). Further, the power consumption in the drying operation (drying process) performed by the heat pump cycle device, etc. is reduced.

According to the above ninth aspect of the present invention, since the refrigerant leaving the radiator passes through the pressure reducing/expansion device and the auxiliary heat exchanger and thereafter flows from the pressure reducing/expansion valve to the evaporator, there can be attained the same effects as in the above fifth to eighth aspects. In a middle stage of the drying operation (drying process) (e.g. for 30 minutes after the lapse of 20 minutes after start of the drying operation) substantially at a predetermined high temperature (e.g. 60° C. to 85° C.) or a temperature close thereto as a circulation air temperature increased by the initial stage of drying operation (drying process), there is performed a normal operation in which the refrigerant leaving the radiator bypasses the pressure reducing/expansion device and the auxiliary heat exchanger and flows through the pressure reducing/expansion valve to the evaporator, making it possible to perform the drying operation (drying process) at a predetermined high temperature (e.g. 60° C. to 85° C.). In a latter stage of the drying operation (drying process) (e.g. for 40 minutes after the lapse of 50 minutes after start of the drying operation), whether the auxiliary heat exchanger is to be bypassed or act as a radiator for the water stored in the water storage tank is switched from one to the other intermittently at a certain duty ratio, thereby radiating a certain quantity of heat to water to prevent excessive accumulation of heat into the circulation air. In this way it is possible to maintain appropriate evaporation temperature and discharge temperature. Further, by making the auxiliary heat exchanger function as a radiator continuously in the final stage of the drying operation to increase the cooling capacity of the heat pump cycle device and reduce the temperature of the circulation air, the laundry temperature can be made appropriate for taking out the laundry by hand.

According to the above tenth aspect of the present invention, in a laundry washing machine wherein washing, rinsing, spin-drying and drying operation (drying process) of the laundry are performed within a rotary drum, rinsing water is stored in a water storage tank. Moreover, the heat pump cycle device constitutes a refrigerant circuit so that the refrigerant leaving the radiator passes through both pressure reducing/expansion device and auxiliary heat exchanger and this auxiliary heat exchanger undergoes heat exchange with the water stored in the water storage tank, whereby the circulation air cooling capacity of the evaporator installed within the air circulation path is deteriorated. Consequently, the air temperature at the evaporator outlet, i.e., at the radiator inlet, rises and so does the air temperature at the radiator outlet. As a result, the rise in the temperature of the radiator in an initial stage of the drying operation is quickened. Therefore, in case of performing the laundry drying operation (drying process) by the heat pump cycle device, it is possible to increase the speed of temperature rise of the circulation air in an initial stage of the drying operation (drying process) (e.g. for 20 minutes after start of the drying operation) and hence possible to shorten the time of the drying operation (drying process). In a latter stage of the drying operation (drying process) (e.g. for 40 minutes after the lapse of 50 minutes after start of the drying operation), the refrigerant leaving the radiator does not undergo any substantial pressure reducing/expanding action by the pressure reducing/expansion device, so that the auxiliary heat exchanger assumes a state of operation of a secondary radiator. Consequently, the circulation air heating effect by the radiator within the air circulation path is somewhat deteriorated and the operation mode becomes a cooling operation mode in which the laundry temperature is reduced gradually. In this way, while the drying operation (drying process) is performed, the laundry temperature at the end of the drying operation (drying process) can be made an appropriate temperature for taking out the laundry by hand. The water in the water storage tank which has been cooled or frozen by the auxiliary heat exchanger in an initial state of the drying operation (initial stage of the drying process) becomes hot water for heating by the auxiliary heat exchanger in a latter stage of the drying operation (drying process). By making the hot water employable as washing water in the next washing it is possible to obtain an effect of laundry stains being removed to a satisfactory extent.

According to the above eleventh aspect of the present invention, since the temperature of the laundry heated in the drying operation (drying process) can be cooled to an appropriate temperature by the cooling-down process just after termination of the drying operation (drying process), whereby it is possible to eliminate the danger caused by taking out the laundry which is still high in temperature.

BRIEF DESCRIPTION OF THE DRAWINGS

FIG. 6 is a diagram showing the states of opening/closing operations of electromagnetic opening/closing valves in FIG. 5 according to the second embodiment;

FIG. 7 is a diagram showing the states of operations of an electromagnetic opening/closing valve and pressure reducing/expansion valves in FIG. 8 according to the third embodiment.

DETAILED DESCRIPTION OF PREFERRED EMBODIMENTS

The drying unit according to the present invention comprises a heat pump cycle device performing a cycle of radiating, with use of a radiator, the heat of a refrigerant compressed by a compressor, then passing the refrigerant through a pressure reducing/expansion valve, evaporating the refrigerant by an evaporator and compressing the refrigerant again by the compressor, an air circulation path for allowing air to be circulated by a blower in such a manner that air heated by the radiator is introduced into a drying chamber to dry the laundry, exhaust air discharged from the drying chamber is passed through the evaporator, then is heated again by the radiator, and the air this dehumidified is circulated by the blower, and an external heat source applying device for applying the heat of an external heat source to the evaporator to quicken the rise in temperature of the air in an initial stage of the drying operation (in an initial stage of the drying process). Embodiments of the present invention will be described below.

First Embodiment

Figure 1:
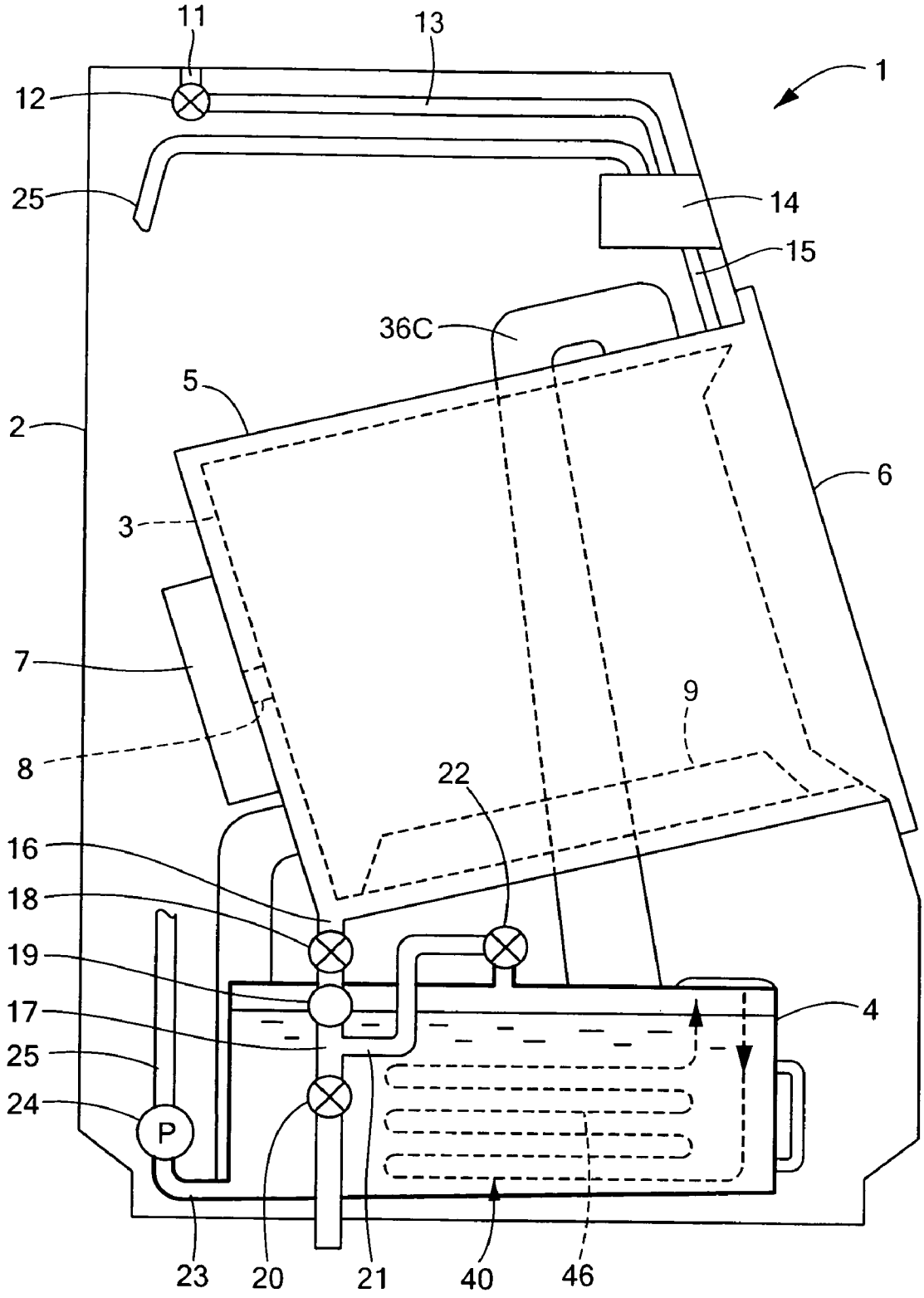
FIG. 1 is a vertically sectional left side view showing schematically an internal construction of a laundry washing/drying machine equipped with a drying unit according to a first embodiment of the present invention.
Figure 2:
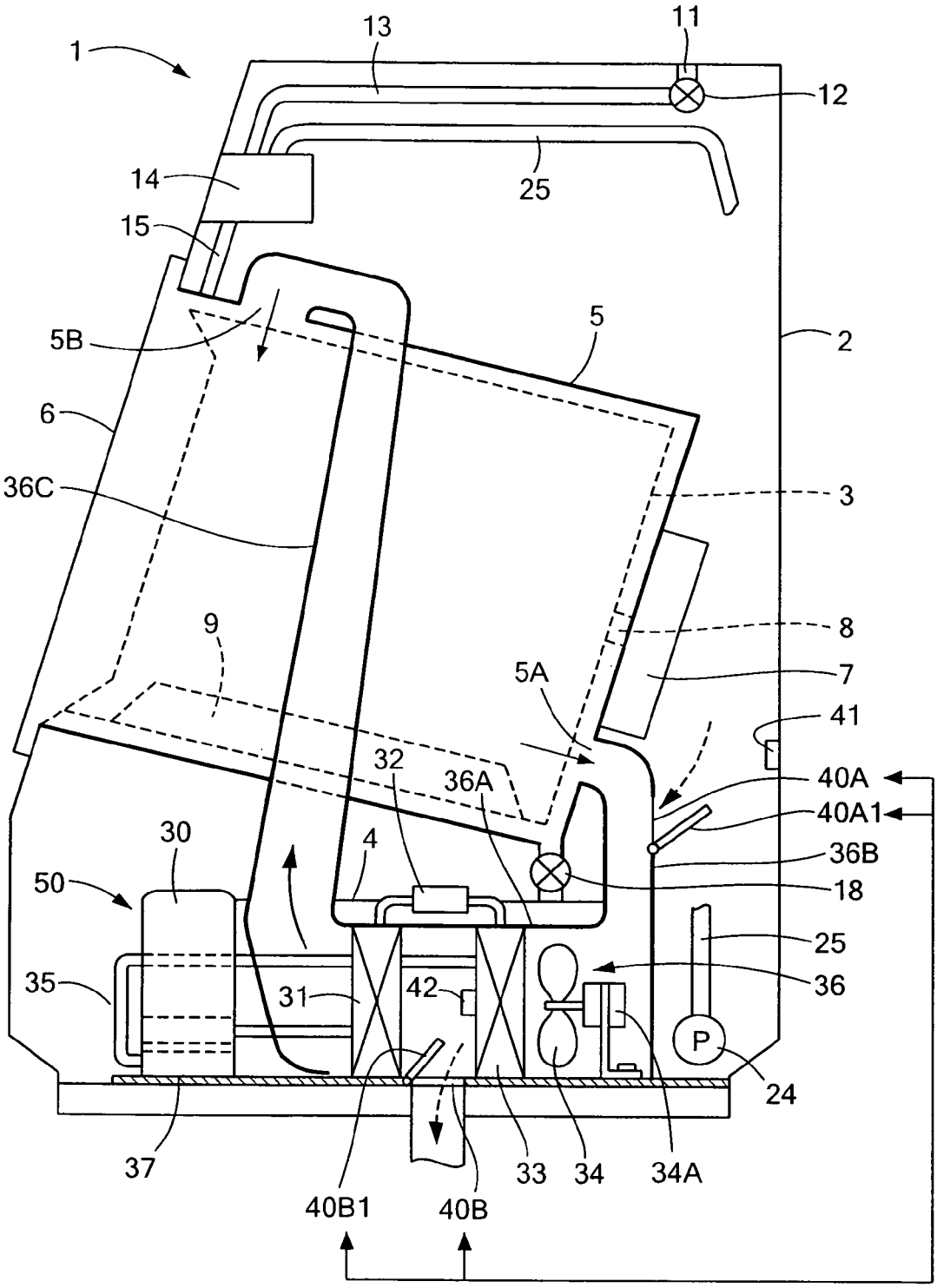
FIG. 2 is a vertically sectional right side view showing schematically an internal construction of a laundry washing/drying machine equipped with a drying unit according to a first embodiment of the present invention.
Figure 3:
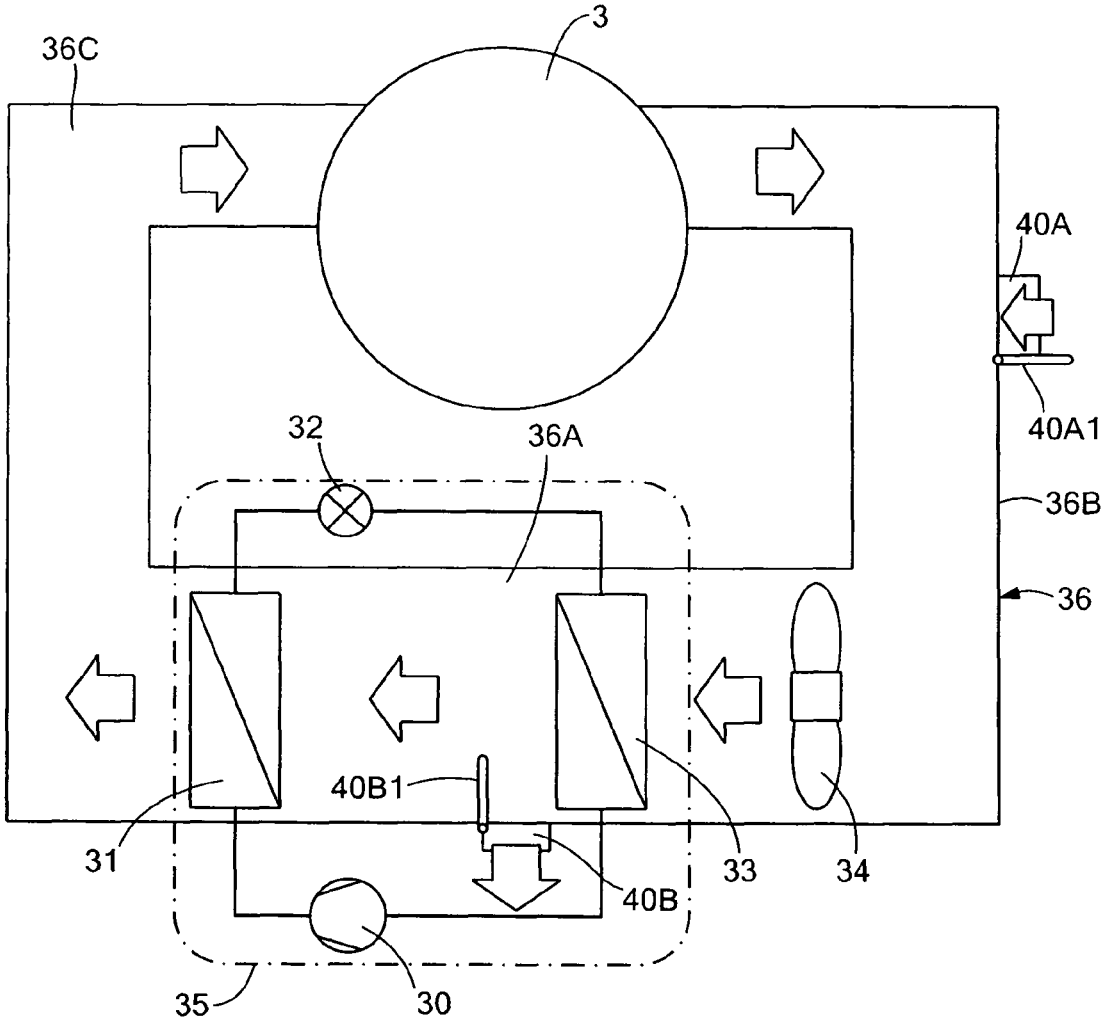
FIG. 3 is a diagram showing an air circulation path in the drying unit according to the first embodiment.
Figure 4:
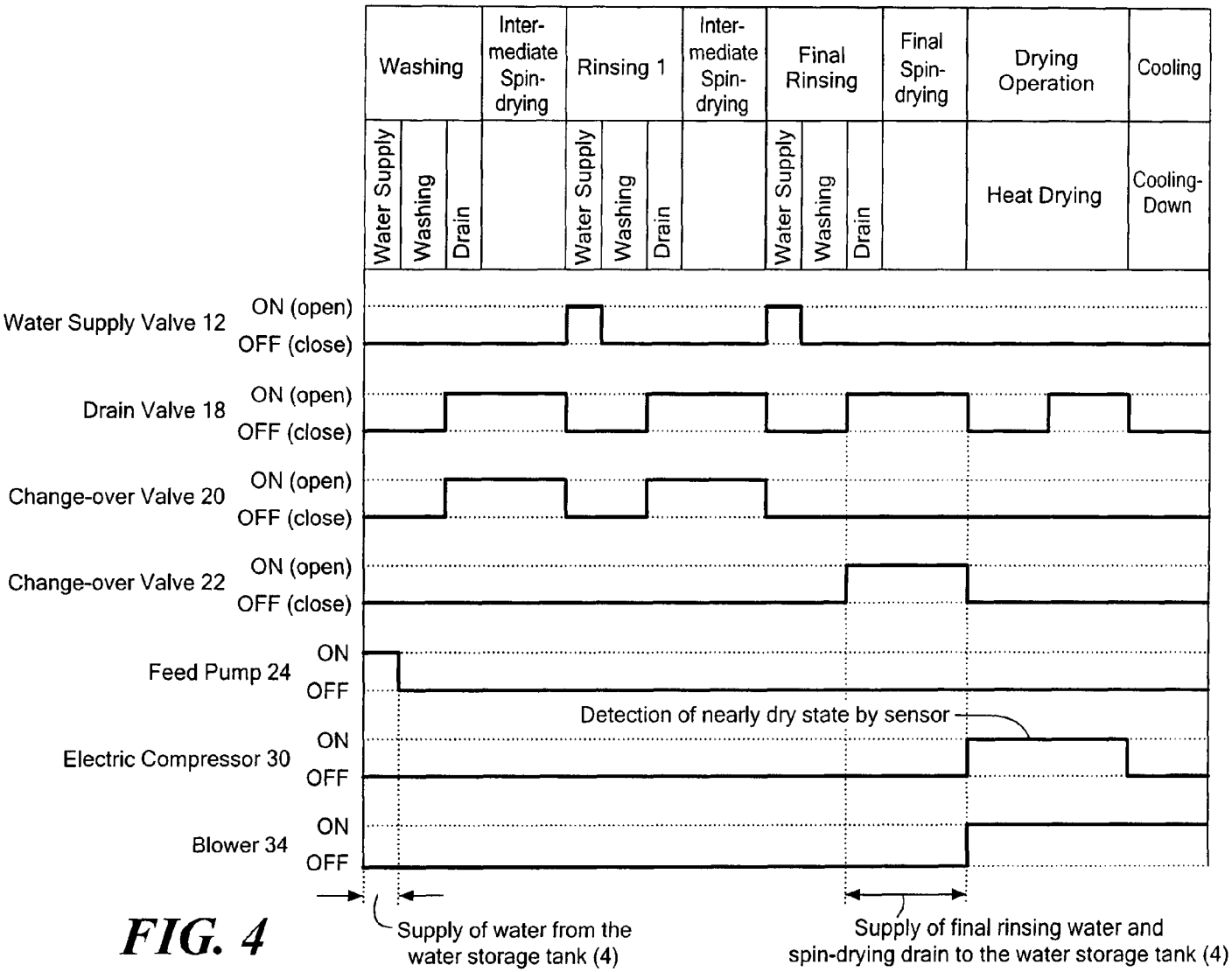
FIG. 4 is a time chart showing the operations of various components of the laundry washing/drying machine according to the first embodiment.

As a first embodiment of the present invention, a description will be given below about a construction in which a drying unit according to the present invention is applied to a laundry washing/drying machine 1 which performs washing, rinsing, spin-drying and drying of the laundry within a rotary drum 3. FIG. 1 is a vertically sectional left side view showing schematically an internal construction of a laundry washing/drying machine equipped with a drying unit according to the present invention, FIG. 2 is a vertically sectional right side view thereof, FIG. 3 is a diagram showing an air circulation path in the drying unit, and FIG. 4 is a time chart showing operations of various components of the laundry washing/drying machine.

In FIG. 1, in a laundry washing/drying machine 1 equipped with a drying unit 50 according to the present invention, a shell of the machine is defined by a housing 2, a rotary drum 3 is disposed centrally of the housing 2, a water storage tank 4 is disposed on one side (left side in the figure) below the rotary drum 3, and the drying unit 50 is disposed on the other side (right side in the figure) below the rotary drum 3.

The rotary drum 3 is in a cylindrical shape having a front opening and is received coaxially within an outer vessel 5 which is also in a cylindrical shape having a front opening. A washing vessel is formed by both rotary drum 3 and outer vessel 5. The rotary drum 3 is in a so-called oblique drum form in which its front opening faces obliquely upward. The front opening of the rotary drum 3 and that of the outer vessel 5 are opened and closed by a door 6 which is hinged for opening and closing motion to a front face of the housing 2. With a motor 7 secured to a rear face of the outer vessel 5, the rotary drum 3 is supported rotatably about a rotary shaft 8.

For washing, water is stored within the outer vessel 5. For the supply of water into the outer vessel 5 there is formed a water supply port 11 in an upper surface of the housing 2. One end of a water supply pipe 13 with a water supply valve 12 disposed therein is connected to the water supply port 11, while the other end of the water supply pipe 13 is connected to a detergent box 14. The detergent box 14 is connected to the interior of the outer vessel 5 through a communication pipe 15. With the door 6 closed, the interior of the outer vessel 5 is held in an air- and liquid-tight state. In the peripheral surface of the rotary drum 3 there are formed a large number of small holes for entry of water from the interior of the outer vessel 5 into the rotary drum and exit thereof from the same drum. For washing, water is stored in a low bottom portion within the outer vessel 5 and this water is stored also within the rotary drum 3. A baffle 9 is disposed at an appropriate position within the rotary drum 3. The door 6 is opened and the laundry is placed into the rotary drum 3 from the front side of the housing 2. The door 6 is then closed and the rotary drum 3 is rotated with the motor 7 by operation of a switch. The laundry containing water within the rotary drum 3 is lifted by the baffle 9 and falls naturally, whereby washing takes place.

A drain port 16 is formed in a lowest end of the bottom of the outer vessel 5 and a drain pipe 17 extending to the exterior of the housing 2 is connected to the drain port 16. In the drain pipe 17 there are mounted, in order from the drain port 16 side, a drain valve 18, a lint filter 19 and a change-over valve 20. When the drain valve 18 and the change-over valve 20 are open, the water present within the outer vessel 5 is drained.

The water storage tank 4 stores rinsing water which has been used after storage within the outer vessel 5 (it is preferable to store the final rinsing water in order to use as clean water as possible; in FIG. 4 the water storage tank stores both final rinsing water and water obtained in the final spin-drying process after the final rinsing). The water storage tank 4 has a sealed structure. For conducting water stored within the outer vessel 5 to the water storage tank 4, one end of a branch pipe 21 is connected to the drain pipe 17 at a position between the lint filter 19 and the change-over valve 20, the branch pipe 21 extending through an upper surface of the water storage tank 4 via a change-over valve 22 and communicating with the interior of the water storage tank 4. When the change-over valve 20 is closed and the drain valve 18 and the change-over valve 22 are open, the rinsing water stored within the outer vessel 5 is conducted into the water storage tank 4.

For using the rinsing water stored within the water storage tank 4 as washing water in the succeeding washing operation there is provided a water supply pipe 25. One end of the water supply pipe 25 is connected to a water supply port 23 formed in the lowest position of the water storage tank 4 and the other end of the water supply pipe 25 is connected to the detergent box 14 via a feed pump 24. In the succeeding washing operation, the pump 24 is driven, whereby the rinsing water stored in the water storage tank 4 is supplied through the water supply pipe 25 into the detergent box 14 and is then conducted into the outer vessel 5 through the communication pipe 15. When the level of the rinsing water stored in the water storage tank 4 rises to a predetermined level, the change-over valve 22 is closed to prevent entry of rinsing water into the water storage tank 4 and both drain valve 18 and change-over valve 20 become open to drain surplus rinsing water to the exterior of the housing 2.

In the laundry washing/drying machine 1, a washing chamber, a rinsing chamber, a spin-drying chamber and a drying chamber are formed within the rotary drum 3 for washing, rinsing, spin-drying and drying the laundry within the rotary drum 3. To dry the laundry within the rotary drum 3, a drying unit 50 for dehumidifying and hot air drying for the laundry is disposed side by side with the water storage tank 4 within the housing 2.

The drying unit 50 includes a heat pump cycle device 35 for performing a cycle of radiating, with use of a radiator 31, the heat of a refrigerant compressed by an electric compressor 30, then passing the refrigerant through a pressure reducing/expansion valve 32, evaporating it in an evaporator 33 and again compressing it by the compressor 30, an air circulation path 36 for allowing air to be circulated by a blower 34 in such a manner that air heated by the radiator 31 is conducted into the rotary drum 3 as a drying chamber to dry the laundry, exhaust air discharged from the drying chamber (rotary drum) 3 is dehumidified in the evaporator 33 and is again heated by the radiator 31, and an external heat source applying device 40 for applying the heat of an external heat source to the evaporator 33 so as to quicken the rise in temperature of the circulation air in an initial stage of the drying operation (initial stage of the drying process). The compressor 30, radiator 31, evaporator 33 and blower 34 are fixed onto a flat plate-like unit base 37.

The air circulation path 36 is made up of a duct portion 36A wherein the radiator 31, evaporator 33 and blower 34 are accommodated, a duct portion 36B which conducts air leaving an air outlet 5A formed in a lower position of the rear face of the outer vessel 5 into a suction side of the blower 34, and a duct portion 36C which conducts air heated by the radiator 31 into an air inlet 5B formed in a front position of an upper surface of the outer vessel 5. The duct portion 36A is formed together with or on the unit base 37. The blower 34 is a propeller fan which is rotated by an electric motor 34A or a fan of another form. In the drawing it is in the form of a propeller fan. The blower 34 may be located at any position in an air path portion from the air outlet 5A up to the air inlet 5B in the air circulation path 36. The compressor 30 and the pressure reducing/expansion valve 32 are disposed outside the air circulation path 36.

The outer vessel 5 is constructed so as to be air- and liquid-tight in a closed state of the door 6. With the door 6 closed, the air circulation path 36 assumes an air-tight state. With operation of the blower 34, the air leaving the rotary drum 3 through a large number of small holes formed in the peripheral surface of the rotary drum enters the outer vessel 5, then flows out from the air outlet 5A and reaches the suction side of the blower 34, then is allowed to pass through the evaporator 33 and the radiator 31 in this order by the blower 34, then enters the outer vessel 5 through the air inlet 5B, further flows into the rotary drum 3 through the many small holes formed in the peripheral surface of the rotary drum, then again leaves the air outlet 5A and reaches the suction side of the blower 34 in the same way as above. Such an air circulation is conducted.

After the washing, rinsing and spin-drying of the laundry are over within the rotary drum 3, a drying operation (drying process) is started with operation of the heat pump cycle device 35. In this drying process, with operation of the compressor 30, the heat pump cycle device 35 operates and so does the blower 34.

With the lapse of time after operation of the heat pump cycle device 35 and of the blower 34, there are performed condensation of the refrigerant by the radiation of heat in the radiator 31 and evaporation of the refrigerant in the evaporator 33. Further, with circulation of air, the water contained in the laundry within the rotary drum 3 is evaporated by the air heated in the radiator 31 and the air which contains the moisture of the laundry in the rotary drum 3 is condensed and dehumidified by the evaporator 33 when passing through the evaporator 33 whose temperature drops to 0° C. or so. The resultant condensate flows down as dehumidified water. This dehumidified water is drained from a dehumidified water drain port formed through the unit base 37. This dehumidified water drain port can be used also as an air discharge port 40B to be described later. There may be adopted a construction wherein the water drained from the dehumidified drain port joins the water flowing in the drain pipe 17 and the joined flow is drained.

The air dehumidified by the evaporator 33 is heated by the radiator 31 and the thus-heated air is conducted into the air inlet 5B formed in a front position of the upper surface of the outer vessel 5, then flows again into the rotary drum 3 to heat the laundry present within the same drum, then flows out again from the air outlet 5A of the outer vessel 5 as moisture-containing air resulting from evaporation of water and reaches the suction side of the blower 34. In this way there is performed a circulation involving evaporation of water contained in the laundry within the rotary drum 3 with air heated in the evaporator and dehumidifying performed by the evaporator 33, whereby the drying of the laundry within the rotary drum 3 is effected.

As the drying operation (drying process) starts and with input to the compressor 30 and input to the electric motor 34A of the blower 34, the internal temperature of the air circulation path 36 rises gradually, but in an initial stage of the drying operation (initial stage of the drying process) the heat present within the air circulation path is deficient and therefore the drum inlet air cannot be heated quickly up to a sufficiently high temperature (e.g. 70° C. or so). Moreover, since air which has been cooled to a low temperature (0° C. or so) by the evaporator 33 is heat-exchanged with the radiator 31, particularly the temperature of air passing through the radiator 31 in an initial stage of the drying operation (drying process) is low and so is the temperature of air circulating through the air circulation path 36. Thus, the heat present within the air circulation path is deficient, so that the heat pump effect of the heat pump cycle device 35 is low and in this state the laundry present within the rotary drum 3 cannot be quickly heated up to a sufficiently high temperature, that is, the water evaporation effect of the laundry is low.

In the present invention, for quickening the rise in temperature of the air circulating through the air circulation path 36 in an initial stage of the drying operation (initial stage of the drying process), there is provided a technique of quickening the rise in temperature of the air passing through the radiator 31 and thereby raising the heating temperature for the laundry present within the rotary drum 3 to promote the laundry water evaporating effect. In the present invention, for compensating the deficiency of heat within the air circulation path and thereby improving the heat pump effect of the heat pump cycle device 35 and improving the air heating effect attained by the radiator 31, there is provided the external heat source applying device 40 which applies the heat of an external heat source to the evaporator 33.

The temperature of ambient air present around the laundry washing/drying machine 1 is assumed to be 20° C. or so and it is used as an external heat source in the external heat source applying device 40. To this end, an intake port 40A for the intake of ambient air is formed in the air path portion extending from the rotary drum 3 as the drying chamber up to the evaporator 33 in the air circulation path 36 in such a manner that the introduced ambient air joins the air circulating through the air circulation path, and an air discharge port 40B for discharging a portion of the air circulating through the air circulation path 36 to the environs is formed in the air path portion extending from the evaporator 33 up to the radiator 31. In the illustrated embodiment the air inlet port 40A is formed in the duct portion 36B and the air discharge port 40B is formed in the unit base 37 which is a part of the duct portion 36A.

With the door 6 closed, the air circulation path 36 assumes an air-tight state and therefore, for the intake of ambient air into the air circulation path 36, an opening/closing mechanism is provided in either the air intake port 40A or the air discharge port 40B and the other port is kept open, or opening/closing mechanisms are provided in both ports 40A and 40B to open or close both ports simultaneously. In the illustrated embodiment, opening/closing mechanisms 40A1 and 40B1 are provided in the air intake port 40A and the air discharge port 40B, respectively. The opening/closing mechanisms 40A1 and 40B1 have respective opening/closing plates which are each opened and closed by solenoid or an electric motor. The opening and closing operations are controlled by a control section (not shown) on the basis of a specific enthalpy of the outlet-side temperature of air in the evaporator 33 and the temperature of ambient air.

The evaporator 33 is a heat exchanger formed in such a manner that parallel rectilinear portions as right and left U-shaped portions of a wholly meandering refrigerant pipe extend through a large number of juxtaposed thin aluminum sheet-like fins. The air circulating through the air circulation path 36 passes through air passages each formed between adjacent said sheet-like fins. In the evaporator 33, an inlet-side pipe of the refrigerant having passed through the pressure reducing/expansion valve 32 is disposed on the air outlet side and an outlet-side pipe of the refrigerant flowing back to the compressor 30 is disposed on the air inlet side. With operation of the control section, the pressure reducing/expansion valve 32 functions to adjust the size of the refrigerant flowing passage to an appropriate size in accordance with the temperature of the refrigerant outlet-side pipe disposed on the air inlet side of the evaporator 33.

According to the above construction, in the drying operation (drying process), the heat pump cycle device 35 operates with operation of the compressor 30 and the blower 34. The rotary drum 3 rotates for uniform drying of the laundry. Then, both opening/closing mechanisms 40A1 and 4081 open and the ambient air introduced from the air intake port 40A flows into the evaporator 33 to improve the heat absorbing effect, then a portion of the air having passed through the evaporator 33 is discharged from the air discharge port 40B. The air leaving the evaporator 33 is low in temperature (0° C. or so) because of it being cooled in the evaporator 33, but since a portion thereof is discharged from the air discharge port 40B, the rise in temperature of the radiator 31 becomes faster than when such discharge of the air is not performed, so that the temperature rising speed of the air leaving the radiator 31 becomes higher. This is repeated, whereby the rise in temperature of the air circulating through the air circulation path 36 becomes faster and so does the heating temperature for the laundry in the rotary drum 3. Consequently, the laundry water evaporating effect can be promoted already in an initial stage of the drying operation (drying process).

When the temperature of the air circulating through the air circulation path 36 has risen to a level above the predetermined temperature with progress of the drying operation (drying process) by the heat pump cycle device 35, it is no longer necessary to introduce the ambient air. Therefore, both or one of the air intake port 40A and the air discharge port 40B is controlled to open or close on the basis of specific enthalpies of the temperature, humidity on the air outlet side of the evaporator 33 and the temperature, humidity of ambient air.

When the specific enthalpy of ambient air is larger than that of the outlet-side air of the evaporator 33, both air intake port 40A and air discharge port 40B are opened. In this embodiment, both opening/closing mechanisms 40A1 and 40B1 for the air intake port 40A and the air discharge port 40B are opened. When the specific enthalpy of ambient air is smaller than that of the outlet-side air of the evaporator 33, both or one of the air intake port 40A and the air discharge port 40B is closed. In this embodiment, both opening/closing mechanisms 40A1 and 40B1 for the air intake port 40A and the air discharge port 40B are closed.

For this control there are provided temperature and humidity sensors 42 (both a temperature sensor and a humidity sensor) for detecting the air temperature and humidity on the air outlet side of the evaporator 33 and temperature and humidity sensors 41 (both a temperature sensor and a humidity sensor) for detecting the temperature and humidity of ambient air. Specific enthalpies are calculated by the control section (not shown) on the basis of the temperatures and humidity detected by the temperature and humidity sensors 41, 42. Then, as described above, when the specific enthalpy of ambient air is larger than that of the outlet-side air in the evaporator 33, both air intake port 40A and air discharge port 40B are opened to introduce ambient air. Even without using such humidity sensors actually, the calculation and comparison of specific enthalpies may be done assuming that the relative humidity of the evaporator outlet-side air is 100% and the humidity of ambient air is 60%.

When the specific enthalpy of ambient air is smaller than that of the outlet-side air in the evaporator 33, the temperature of the circulating air heated by the radiator 31 is fairly high and therefore it is no longer necessary to introduce ambient air. Therefore, both or one of the air intake port 40A and the air discharge port 40B is closed, whereby the operation mode becomes the normal operation mode and the drying operation can be done in a satisfactory manner by the circulating air heated by the radiator 31.

As described above, in the evaporator 33 wherein the refrigerant inlet-side pipe is disposed on the air outlet side and the refrigerant outlet-side pipe is disposed on the air inlet side, the temperature and humidity detected by the temperature and humidity sensors 42 may be the temperature and humidity of the refrigerant inlet-side pipe and not the air temperature and humidity on the air outlet side of the evaporator 33, then on the basis of the detection results the air intake port 40A and the air discharge port 40B may be controlled to open or close in the same manner as above.

The heat pump cycle device 35 adopts a method wherein carbon dioxide refrigerant or refrigerant (designated carbon dioxide refrigerant) containing a large amount of carbon dioxide is compressed by the compressor 30. The compressor 30 adopts a two-stage compressing method wherein the refrigerant flowing back from the evaporator 33 is compressed in a first-stage compressing mechanism section, then is compressed in a second-stage compressing mechanism section and enters the radiator 31, in which it radiates heat and is condensed. In case of using carbon dioxide refrigerant, the refrigerant pressure is higher than that of fluorocarbon refrigerants and hence it is possible to increase the temperature of air heated by the radiator 31.

The laundry washing/drying machine 1 starts operation when the user of the machine 1 operates a Start Button in a mode selected by the user through an operating section, and operations from the washing process up to the drying operation (drying process) are performed. The drying operation (drying process) may be terminated upon lapse of a predetermined time after the start with use of a timer. However, the time required for sufficient drying differs depending on for example the type and amount of the laundry and therefore it is preferable to use a humidity sensor for detecting the humidity of air flowing in the air path portion from the air outlet 5A up to the evaporator 33 in the air circulation path 36 and terminate the drying operation (drying process) when the control section determines the state of drying to be a predetermined state of drying on the basis of a detected value provided from the said sensor. The operation of the compressor 30 and that of the blower 34 are terminated upon termination of the drying operation (drying process) and the door 6 which has been locked after the operation of the washing Start Button is unlocked and can be opened.

In the drying operation (drying process) the laundry and metallic pieces if attached to the laundry are heated to a considerably high temperature, so if the door 6 is opened and the user takes out the laundry just after termination of the drying operation (drying process), the user will feel hot in his or her hand and it is dangerous to touch the metallic pieces attached to the laundry. To avoid this, as shown in FIG. 4, there is provided a laundry cooling-down process just after termination of the drying operation (drying process). In this cooling-down process, the blower 34 is turned ON for a predetermined time by a timer although the compressor 30 is OFF. Alternatively, there is used a temperature sensor for detecting the temperature of air flowing through the air path portion from the air outlet 5A up to the evaporator 33 in the air circulation path 36 and the blower 34 is turned OFF when the control section determines a lowering to a predetermined temperature on the basis of a detected value provided from the said sensor. In this way it is possible to eliminate the aforesaid dangerous state.

Second Embodiment

Figure 5:
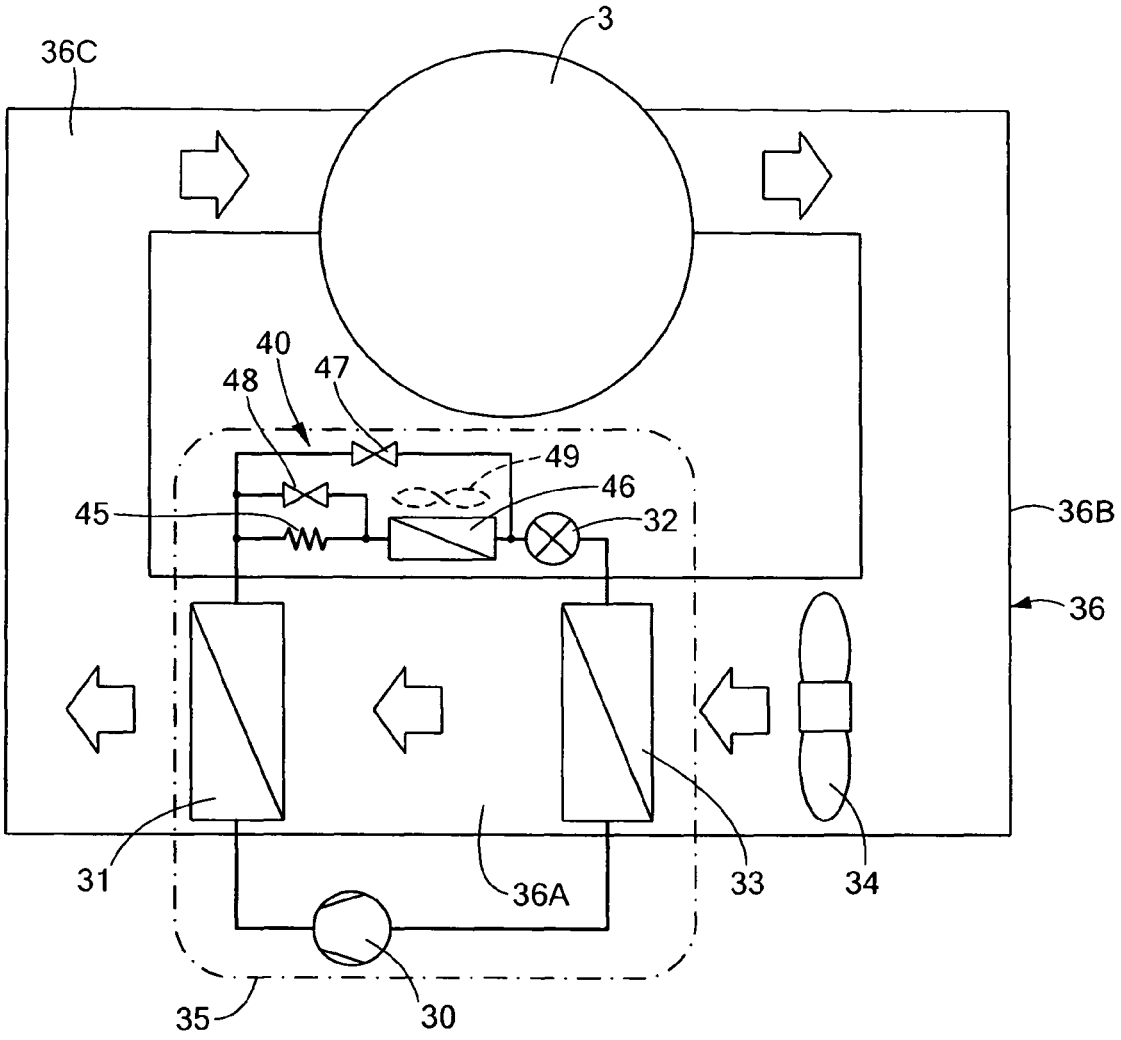
FIG. 5 is a diagram showing an air circulation path in a drying unit according to a second embodiment of the present invention.

Next, a second embodiment of the present invention will be described. FIG. 5 shows an air circulation path in a drying unit 50 according to a second embodiment of the present invention. An internal construction of a laundry washing/drying machine using this drying unit 50 corresponds substantially to an internal construction wherein the heat pump cycle device shown in FIGS. 1 and 2 is replaced by a heat pump cycle device 35 in an air circulation path shown in FIG. 5. As to a time chart showing operations of various components of the laundry washing/drying machine, it is the same as that of FIG. 4 and therefore an explanation thereof is as given in the first embodiment.

In the air circulation path of the drying unit 50 according to the present invention which is shown in FIG. 5, the same functional portions as in the first embodiment are denoted by the same reference numerals as in the first embodiment. It is the heat pump cycle device 35 that is a difference of this second embodiment from the first embodiment.

The drying unit 50 of this second embodiment includes a heat cycle pump device 35 which performs a cycle of radiating, with a radiator 31, the heat of refrigerant compressed by a compressor 30, passing the refrigerant through a capillary tube 45 disposed as a pressure reducing/expansion device 45 and an auxiliary heat exchanger 46, then passing the refrigerant through a pressure reducing/expansion valve 32 and an evaporator 33 in this order, and again compressing it by the compressor 30, an air circulation path 36 allowing air to be circulated by a blower 34 in such a manner that the air heated by the radiator 31 is introduced into a rotary drum 3 as a drying chamber to dry the laundry, then exhaust air discharged from the drying chamber (rotary drum) 3 is dehumidified by the evaporator 33 and is again heated by the radiator 31, and, as is the case with the first embodiment, an external heat source applying device 40 provided so as to allow refrigerant passing through the auxiliary heat exchanger 46 to undergo heat exchange with an external heat source when the auxiliary heat exchanger 46 functions as a refrigerant evaporating portion in order to quicken the rise in temperature of the circulation air in an initial stage of the drying operation (initial stage of the drying process).

An electromagnetic opening/closing valve 47 is connected in parallel with a series circuit of the capillary tube 45 and the auxiliary heat exchanger 46 and an electromagnetic opening/closing valve 48 is connected in parallel with the capillary tube 45. The compressor 30, pressure reducing/expansion valve 32, auxiliary heat exchanger 46 and electromagnetic opening/closing valves 47, 48 are disposed on a unit base 37 outside the air circulation path 36.

Also in this second embodiment the drying unit 50 is applied to a laundry washing/drying machine 1 wherein a laundry washing chamber is the interior of the rotary drum 3 and the laundry is washed and rinsed using rinsing water with rotation of the rotary drum 3 within the same drum, followed by spin-drying and subsequent drying operation (drying process) within the rotary drum 3. As shown in FIG. 4, rinsing water in the final rinsing process is stored in a water storage tank 4.

When the drying operation (drying process) is started, in an initial stage thereof, as shown in FIG. 6, the electromagnetic opening/closing valves 47 and 48 are closed and the heat pump cycle device 35 performs a cycle of radiating, with the radiator 31, the heat of refrigerant compressed by the compressor 30, then passing the refrigerant through the capillary tube 45 as the pressure reducing/expansion device and the auxiliary heat exchanger 46, thereafter passing the refrigerant through the pressure reducing valve 32 and the evaporator 33 in this order and again compressing it by the compressor 30. In the same manner as in the first embodiment air is circulated by the blower 34 so that the air heated by the radiator 31 is introduced into the rotary drum 3 to dry the laundry, exhaust air discharged from the rotary drum 3 is dehumidified by the evaporator 33 and is then heated again by the radiator 31.

In order to quicken the rise in temperature of the circulating air in an initial stage of the drying operation (initial stage of the drying process), the auxiliary heat exchanger 46 heat-exchanges with the water stored in the water storage tank 4. Therefore, as indicated with a dotted line in FIG. 1, a refrigerant pipe of the auxiliary heat exchanger 46 is immersed within the water stored in the water storage tank 4. It is assumed that the temperature of the water stored in the water storage tank 4 is almost equal to the temperature of ambient air present around the laundry washing/drying machine 1, which is 20° C. or so.

Thus, in an initial stage of the drying operation (initial stage of the drying process), refrigerant which has been pressure-reduced and expanded by the capillary tube 45 flows into the auxiliary heat exchanger 46, whereby the auxiliary heat exchanger 46 acts as part of a refrigerant evaporating function section, namely, as an evaporator. At this time, the auxiliary heat exchanger 46 heat-exchanges with the water stored in the water storage tank 4 and absorbs heat from the water, so that the synthetic heat absorbing effect attained by the evaporator 33 acting as the refrigerant evaporating function section and the auxiliary heat exchanger 46 in the heat pump cycle device 35 is promoted. Due to refrigerant evaporation in the auxiliary heat exchanger 46 the circulating air cooling effect induced by the evaporation of refrigerant in the evaporator 33 after passing through the pressure reducing/expansion valve 32 is deteriorated, so that the temperature rising speed in the radiator 31 becomes high and so does the temperature rising speed of air having passed through the radiator 31 in comparison with the case where the auxiliary heat exchanger 46 is not used. Since this is repeated, the temperature rising speed of the air circulating through the air circulation path 36 becomes high and so does the rising speed of the laundry heating temperature within the rotary drum 3, whereby the laundry water evaporating effect can be promoted already in an initial stage of the drying operation (drying process).

In an initial stage of the drying operation (drying process), for example, when 20 minutes have elapsed after start of the drying operation, the temperature of the circulating air rises to a considerable extent and the temperature of the water stored in the water storage tank 4 is in a dropped state, so that the heat absorbing action by the auxiliary heat exchanger 46 is no longer performed and the operation mode may be switched to the normal operation mode. Therefore, upon lapse of a predetermined time (20 minutes) after start of the drying operation (drying process), the electromagnetic opening/closing valve 47 is open and the electromagnetic opening/closing valve 48 is closed by the timer function of the control section, as shown in FIG. 6, whereby the refrigerant compressed by the compressor 30 radiates heat in the radiator 31, bypasses both capillary tube 45 and auxiliary heat exchanger 46, passes through the electromagnetic opening/closing valve 47, then through the pressure reducing/expansion valve 32 and the evaporator 33 in this order, and is again compressed by the compressor 30. The refrigerant circulates in this way. This is shown in FIG. 6 as a middle stage of the drying operation (drying process) which stage corresponds to the state of normal operation.

In an initial stage of the drying operation (drying process) the water stored in the water storage tank 4 is cooled or frozen by the auxiliary heat exchanger 46. However, in the middle stage of the drying operation (drying process), the cooling of the water in the water storage tank 4 by the auxiliary heat exchanger 46 stops and therefore the water or ice present within the water storage tank 4 is warmed gradually at the ambient temperature.

The middle stage of the drying operation (drying process) which stage corresponds to the normal state of operation continues for, say, 30 minutes. Upon lapse of the 30 minutes a latter stage of the drying operation (drying process) is started by the timer function of the control section. In the latter stage of the drying operation (drying process), as shown in FIG. 6, the electromagnetic opening/closing valve 47 is closed and the electromagnetic opening/closing valve 48 is opened, whereby the refrigerant compressed by the compressor 30 radiates heat in the radiator 31, bypasses the capillary tube 45, then passes through the electromagnetic opening/closing valve 48 and enters the auxiliary heat exchanger 46, then further radiates heat and is condensed in the auxiliary heat exchanger 46, thereafter passes through the pressure reducing/expansion valve 32 and the evaporator 33 in this order and is again compressed by the radiator 30. The refrigerant circulates in this way.

Thus, the auxiliary heat exchanger 46 functions as a radiator, so that the water or ice present within the water storage tank 4 is heated by the auxiliary heat exchanger 46 and the frozen ice melts, or in the case of water, the temperature thereof rises. The latter stage of the drying operation (drying process) continues for, say, 40 minutes in case of adopting the timer function. As shown in FIG. 4, the heated water in the water storage tank 4 can be supplied to the interior of an outer vessel 5 by operation of a pump 24 and used as washing water in the next washing operation, thus making it possible to promote the removal of stains from the laundry in the next washing operation. Upon termination of the latter stage of the drying operation (drying process) the compressor 30 and the blower 34 turn OFF and a door 6 which has been locked after operation of the washing Start Button is unlocked and can be opened.

The laundry washing/drying machine 1 starts operation when the user of the machine operates the Start Button in a mode which the user has selected through the operating section, and there are performed washing process up to drying operation (drying process). The drying operation (drying process) may be terminated by a timer upon lapse of a predetermined time after the start. However, a sufficient drying time differs depending on the type and amount of the laundry, so it is preferable to use a humidity sensor for detecting the humidity of air flowing in the air path portion from an air outlet 5A up to the evaporator 33 in the air circulation path 36 and terminates the drying operation (drying process) when the control section determines a predetermined drying condition on the basis of a detected value provided from the said sensor. In case of adopting the latter method, switching may be made from the middle stage of the drying operation (drying process) to the latter stage of the same operation (process) in the predetermined drying condition by operation of the control section which is based on a detected value provided from the aforesaid humidity sensor and the latter stage of the drying operation (drying process) may be terminated in a sufficient drying condition by operation of the control section based on detection of the humidity sensor.

In connection with the above operation of the laundry washing/drying machine, switching from the initial stage of the drying operation (drying process) to the middle stage of the same operation (process) may be done by calculating in the control section (not shown) a specific enthalpy of ambient air smaller than that of outlet-side air in the evaporator 33 on the basis of detections made by temperature and humidity sensors 41, 42. Further, a lowering of the water temperature to the predetermined temperature in the water storage tank 4 may be detected by a water temperature sensor and the switching may be controlled by the control section (not shown).

In the above construction, switching of the refrigerant passage may be controlled by such a change-over valve as can perform the same switching operation as above instead of using the electromagnetic opening/closing valves 47 and 48.

Also in this second embodiment the heat pump cycle device 35 adopts a method wherein carbon dioxide refrigerant or refrigerant (designated carbon dioxide refrigerant) containing a larger amount of carbon dioxide is compressed by the compressor 30, and the compressor 30 adopts a two-stage compressing method. According to this two-stage compressing method, refrigerant flowing back from the evaporator 33 is compressed in a first-stage compressing mechanism section, then is compressed in a second-stage compressing mechanism section and enters the radiator 31, in which it radiates heat and is condensed. In case of using carbon dioxide refrigerant, the refrigerant pressure is high in comparison with that of fluorocarbon refrigerant and the temperature of air heated by the radiator 31 can be increased.

In the drying operation (drying process) the laundry and metallic pieces if attached to the laundry are heated to a considerably high temperature, so if the door 6 is opened and the user takes out the laundry just after termination of the drying operation (drying process), the user will feel hot in his or her hand and it is dangerous to touch the metallic pieces attached to the laundry. To avoid this, as shown in FIG. 4, there is provided a laundry cooling-down process just after termination of the drying operation (drying process). In this cooling-down process, the blower 34 is turned ON for a predetermined time by a timer although the compressor 30 is OFF. Alternatively, there is used a temperature sensor for detecting the temperature of air flowing through the air path portion from the air outlet 5A up to the evaporator 33 in the air circulation path 36 and the blower 34 is turned OFF when the control section determines a lowering to a predetermined temperature on the basis of a detected value provided from the said sensor. In this way it is possible to eliminate the aforesaid dangerous state.

Third Embodiment

Figure 8:
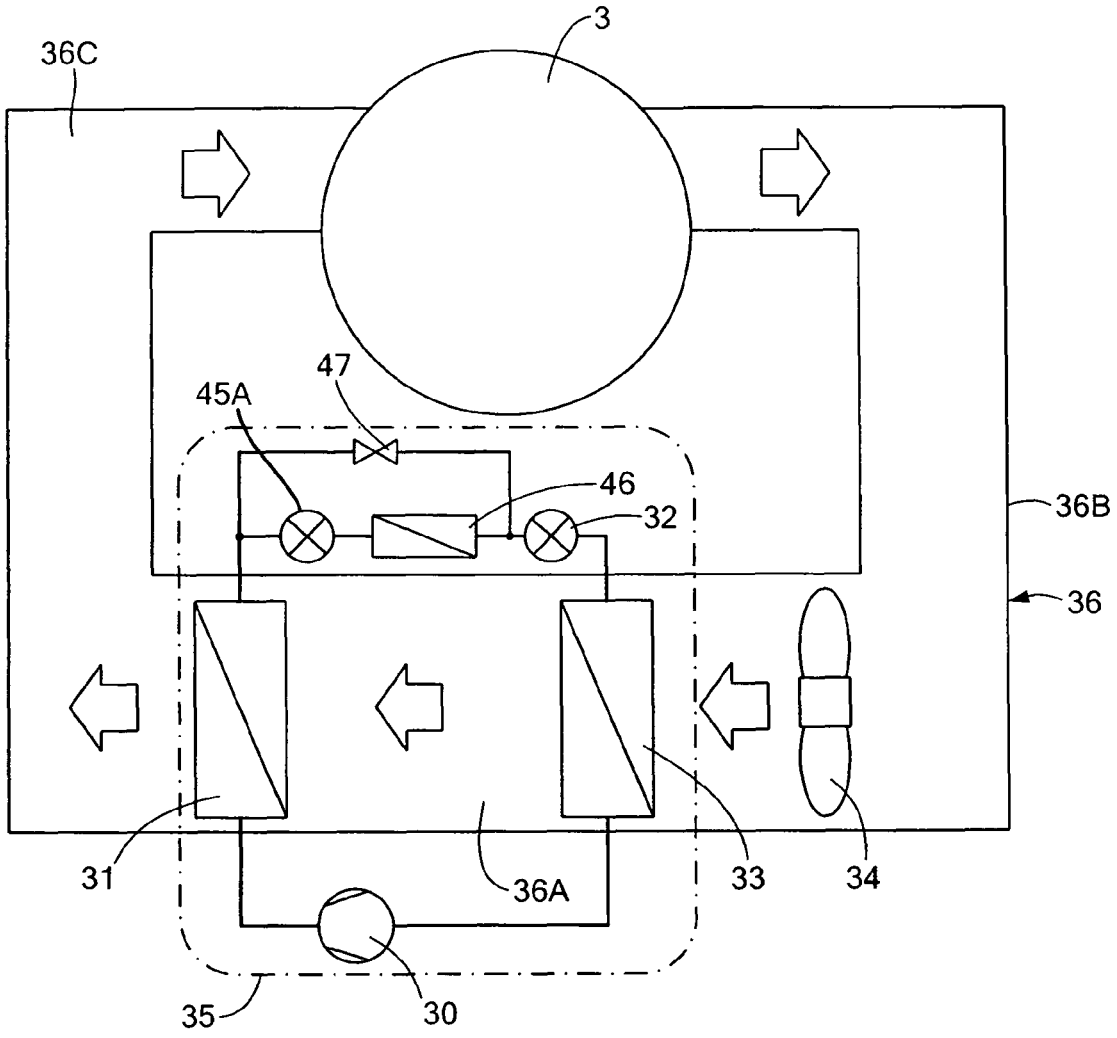
FIG. 8 is a diagram showing an air circulation path in a drying unit according to a third embodiment of the present invention.

A third embodiment of the present invention will now be described. This third embodiment adopts a second pressure reducing/expansion valve 45A instead of the capillary tube 45 as the pressure reducing/expansion device used in the second embodiment. FIG. 8 illustrates an air circulation path formed in a drying unit 50 according to a third embodiment of the present invention. An internal construction of a laundry washing/drying machine using this drying unit 50 corresponds to an internal construction wherein the heat pump cycle device 35 shown in FIGS. 1 and 2 is replaced by a heat pump cycle device disposed in the air circulation path shown in FIG. 8. As to a time chart showing operations of various components of the laundry washing/drying machine, it is the same as that shown in FIG. 4 and therefore an explanation thereof is as given in the first embodiment.

In the air circulation path of the drying unit 50 according to this third embodiment which is shown in FIG. 8, the same functional portions as in the portions as in the first and second embodiments are denoted by the same reference numerals as in the first and second embodiments.

The drying unit 50 of this third embodiment includes a heat pump cycle device 35 for performing a cycle of radiating, with use of a radiator 31, the heat of refrigerant compressed by a compressor 30, passing the refrigerant through a second pressure reducing/expansion valve 45A disposed as a pressure reducing/expansion device and an auxiliary heat exchanger 46, thereafter passing the refrigerant through a first pressure reducing/expansion valve 31 and an evaporator 33 in this order, and again compressing the refrigerant by the compressor 30, an air circulation path 36 for allowing air to be circulated by a blower 34 in such a manner that air heated by the radiator 31 is introduced into a rotary drum 3 as a drying chamber to dry the laundry, then exhaust air discharged from the drying chamber (rotary drum) 3 is dehumidified by the evaporator 33 and is thereafter heated again by the radiator 31, and as in the first embodiment, further includes an external heat source applying device 40 for allowing refrigerant passing through the auxiliary heat exchange 46 to be heat-exchanged with an external heat source when the auxiliary heat exchanger 46 functions as a refrigerant evaporating portion in order to quicken the rise in temperature of the circulating air in an initial stage of the drying operation (initial stage of the drying process).

An electromagnetic opening/closing valve 47 is connected in parallel with a series circuit of the second pressure reducing/expansion valve 45A and the auxiliary heat exchanger 46 and an electromagnetic opening/closing valve 48 is connected in parallel with the second pressure reducing/expansion valve 45A. The compressor 30, pressure reducing/expansion valve 32, auxiliary heat exchanger 46 and electromagnetic opening/closing valves 47, 48 are disposed on a unit base 37 outside the air circulation path 36.

Also in this third embodiment the laundry drying chamber is the interior of the rotary drum 3 and is applied to a laundry washing/drying machine 1 wherein with rotation of the rotary drum 3 the laundry is washed, rinsed with rinsing water, spin-dried and thereafter subjected to drying operation (drying process) in the interior of the rotary drum 3. As shown in FIG. 4, rinsing water used in the final rinsing process is stored in a water storage tank 4.

After start of the drying operation (drying process) and in an initial stage of the same operation (process), as shown in FIG. 7, the electromagnetic opening/closing valve 47 is closed and the pressure reducing/expansion valve 32 is brought into a substantially fully open condition both by the control section, in which fully open condition the valve 32 does not exert any substantial ordinary pressure reducing and expanding action (little or no such action) on the refrigerant. The heat pump cycle device 35 performs a cycle of radiating the heat of refrigerant compressed by the compressor 30, then passing the refrigerant through the second pressure reducing/expansion valve 45A as the pressure reducing/expansion device and the auxiliary heat exchanger 46 in this order, thereafter passing the refrigerant through the pressure reducing/expansion valve 32 and the evaporator 33 in this order, and again compressing the refrigerant by the compressor 30. As in the first embodiment, air is circulated by the blower 34 in such a manner that the air heated by the radiator 31 is introduced into the rotary drum 3 to dry the laundry, exhaust air discharged from the rotary drum 3 is dehumidified by the evaporator 33 and is thereafter heated again by the radiator 31.

The auxiliary heat exchanger 46 heat-exchanges with the water stored in the water storage tank 4 in order to quicken the rise in temperature of the circulating air in an initial stage of the drying operation (drying process). Therefore, as indicated by a dotted line in FIG. 1, a refrigerant pipe of the auxiliary heat exchanger 46 is in an immersed state into the water stored in the water storage tank 4. It is assumed that the temperature of the water stored in the water storage tank 4 is equal to that of ambient air present around the laundry washing/drying machine 1, which is 20° C. or so.

Therefore, in an initial stage of the drying operation (initial stage of the drying process), refrigerant pressure-reduced and expanded by the second pressure reducing/expansion valve 45A flows into the auxiliary heat exchanger 46, so that the auxiliary heat exchanger 46 acts as a refrigerant evaporating function section, i.e., an evaporator. The pressure reducing/expansion valve 45A acts to adjust the size of the refrigerant flowing passage into an appropriate size in accordance with operation of the control section. At this time the auxiliary heat exchanger 46 heat-exchanges with the water stored in the water storage tank 4 and absorbs heat from the water and therefore acts as a refrigerant evaporating function section in the heat pump cycle device 35, but the evaporator 33 does not substantially act as a refrigerant evaporating function section and there is little circulation air cooling effect by refrigerant evaporation in the evaporator 33 after passing through the pressure reducing/expansion valve 32. Accordingly, in comparison with the case where the auxiliary heat exchanger 46 is not provided, the temperature rising speed of the radiator 31 becomes high and so does the rise in temperature of the air having passed through the radiator 31. This is repeated, whereby the rise in temperature of the air circulating through the air circulation path 36 becomes high and so does the rise of the laundry heating temperature in the rotary drum 3. Consequently, the laundry water evaporating effect can be promoted already in an initial stage of the drying operation (drying process).

In an initial stage of the drying operation (drying process), for example, when 20 minutes have elapsed after start of the drying operation, the temperature of the circulating air rises to a considerable extent and the temperature of the water stored in the water storage tank 4 is in a dropped state, so that the heat absorbing action by the auxiliary heat exchanger 46 is not longer performed and the operation mode may be switched to the normal operation mode. Therefore, upon lapse of a predetermined time (20 minutes) after start of the drying operation (drying process), as shown in FIG. 7, the electromagnetic opening/closing valve 47 is opened to make the second pressure reducing/expansion valve 45A highly resistant (closed or brought into a largely throttled state) to refrigerant and the pressure reducing/expansion valve 32 is brought into the normal state of pressure reducing and expanding operation by the timer function of the control section. As a result, the refrigerant compressed by the compressor 30 circulates so as to radiate heat in the radiator 31, bypass the second pressure reducing/expansion valve 45A and the auxiliary heat exchanger 46, then pass through the electromagnetic opening/closing valve 47, further pass through the pressure reducing/expansion valve 32 and the evaporator 33 in this order, and be compressed again by the compressor 30. This is shown in FIG. 7 as a middle stage of the drying operation (drying process) which stage corresponds to the state of normal operation. By the ordinary pressure reducing and expanding operation (throttling operation) of the pressure reducing/expansion valve 32 the refrigerant evaporates in the evaporator 33, radiates heat and is condensed in the radiator 31, and the circulating air is heated by the radiator 31 to heat the laundry present within the rotary drum 3. As a result of this heating, evaporated moisture is dehumidified by the evaporator 33 and the laundry is dried thereby.

In an initial stage of the drying operation (drying process) the water stored in the water storage tank 4 is cooled or frozen by the auxiliary heat exchanger 46. However, in the middle stage of the drying operation (drying process), the cooling of the water in the water storage tank 4 by the auxiliary heat exchanger 46 stops and therefore the water or ice present within the water storage tank 4 is warmed gradually at the ambient temperature.

The middle stage of the drying operation (drying process) which stage corresponds to the normal state of operation continues for, say, 30 minutes. Upon lapse of the 30 minutes a latter stage of the drying operation (drying process) is started by the timer function of the control section. In the latter stage of the drying operation (drying process), as shown in FIG. 7, the electromagnetic opening/closing valve 47 is closed and the second pressure reducing/expansion valve 45A is substantially fully opened in which state the ordinary pressure reducing and expanding action is not substantially exerted on the refrigerant (little or no pressure reducing and expanding action, i.e., no throttling operation). Further, by bringing the pressure reducing/expansion valve 32 into the normal state of pressure reducing and expanding operation, the refrigerant compressed by the compressor 30 radiates heat in the radiator 31, passes nearly as it is through the second pressure reducing/expansion valve 45A and enters the auxiliary heat exchanger 46, then further radiates and is condensed in the auxiliary heat exchanger 46, thereafter is pressure-reduced and expanded by the pressure reducing/expansion valve 32, then passes through the evaporator 33 and is again compressed by the compressor 30. The refrigerant circulates in this way.

Thus, the auxiliary heat exchanger 46 functions as a radiator, so that the water or ice present within the water storage tank 4 is heated by the auxiliary heat exchanger 46 and frozen ice melts, or in the case of water, the temperature thereof rises. The latter stage of the drying operation (drying process) continues for, say, 40 minutes. As shown in FIG. 4, the heated water in the water storage tank 4 can be supplied to the interior of an outer vessel 5 by operation of a pump 24 and used as washing water in the next washing operation, thus making it possible to promote the removal of stains from the laundry in the next washing operation.

The laundry washing/drying machine 1 starts operation when the user of the machine operates the Start Button in a mode which the user has selected through the operating section, and there are performed washing process up to drying operation (drying process). The drying operation (drying process) may be terminated by a timer upon lapse of a predetermined time after the start. However, a sufficient drying time differs depending on the type and amount of the laundry, so it is preferable to use a humidity sensor for detecting the humidity of air flowing in the air path portion from an air outlet 5A up to the evaporator 33 in the air circulation path 36 and terminate the drying operation (drying process) when the control section determines a predetermined drying condition on the basis of a detected value provided from the said sensor. In case of adopting the latter method, switching may be made from the middle stage of the drying operation (drying process) to the latter stage of the same operation (process) in the predetermined drying condition by operation of the control section which is based on a detected value provided from the aforesaid humidity sensor and the latter stage of the drying operation (drying process) may be terminated in a sufficient drying condition by operation of the control section based on detection of the humidity sensor.

In connection with the above operation of the laundry washing/drying machine, switching from the initial stage of the drying operation (drying process) to the middle stage of the same operation (process) may be done by calculating in the control section (not shown) a specific enthalpy of ambient air smaller than that of outlet-side air in the evaporator 33 on the basis of detections may by temperature and humidity sensors 41, 41. Further, a lowering of the water temperature in the water storage tank 4 may be detected by a water temperature sensor and the switching may be controlled by the control section (not shown).

In the above construction, switching of the refrigerant passage may be controlled by such a change-over valve as can perform the same switching operation as above instead of using the electromagnetic opening/closing valves 47 and 48.

Also in this third embodiment the heat pump cycle device 35 adopts a method wherein carbon dioxide refrigerant or refrigerant (designated carbon dioxide refrigerant) containing a large amount of carbon dioxide is compressed by the compressor 30, and the compressor 30 adopts a two-stage compressing method. According to this two-stage compressing method, refrigerant flowing back from the evaporator 33 is compressed in a first-stage compressing mechanism section, then is compressed in a second stage-compressing section and enters the radiator 31, in which it radiates heat and is condensed. In case of using carbon dioxide refrigerant, the refrigerant pressure is high in comparison with that of fluorocarbon refrigerant and the temperature of air heated by the radiator 31 can be increased.

In the drying operation (drying process) the laundry and metallic pieces if attached to the laundry are heated to a considerably high temperature, so if the door 6 is opened and the user takes out the laundry just after the drying operation (drying process), the user will feel hot in his or her hand and it is dangerous to touch the metallic pieces of the laundry. To avoid this, as shown in FIG. 4, there is provided a laundry cooling-down process just after termination of the drying operation (drying process). In this cooling-down process, the blower 34 is turned ON for a predetermined time by a timer although the compressor 30 is OFF. Alternatively, there is used a temperature sensor for detecting the temperature of air flowing in the air path portion from the air outlet 5A up to the evaporator 33 in the air circulation path 36 and the blower 34 is turned OFF when the control section determines a lowering to a predetermined temperature on the basis of a detected value provided from the said sensor. In this way it is possible to eliminate the aforesaid dangerous state.

Fourth Embodiment

According to a fourth embodiment of the present invention the water storage tank 4 used in the second or third embodiment is substituted by a construction wherein the refrigerant passing through the auxiliary heat exchanger 46 heat-exchanges with antifreeze solution stored in an antifreeze solution tank, whereby as in the previous embodiments there is obtained an effect of increasing the temperature rising speed of the circulating air in an initial stage of the drying operation (initial stage of the drying process). In this case, however, since the tank used is the antifreeze solution tank, there is no effect of using hot water stored in the water storage tank 4 for the next washing.

Fifth Embodiment

According to a fifth embodiment of the present invention the water storage tank 4 used in the second or third embodiment is substituted by a construction wherein, as shown in FIG. 5, a blower 49 for causing the auxiliary heat exchanger 46 to be heat-exchanged forcibly with ambient air is provided as one type of the external heat source applying device 40. The blower 49 is ON during the drying operation (drying process). With this construction, as in the previous embodiments, there is obtained an effect of increasing the temperature rising speed of the circulating air in an initial stage of the drying operation (drying process). In this case, however, because the tank used is the antifreeze solution tank, there is no effect of using hot water stored in the water storage tank 4 for the next washing.

Sixth Embodiment

According to a sixth embodiment of the present invention the first and second embodiments, or the first and third embodiments, are combined together, whereby there is obtained an effect of increasing the temperature rising speed of the circulating air in an initial stage of the drying operation (initial stage of the drying process).

INDUSTRIAL APPLICABILITY

The drying unit and the laundry washing/drying machine equipped with the drying unit according to the present invention are not limited to the above embodiments, but are applicable to various other forms insofar as they do not depart from the technical scope of the present invention.

What is claimed is:

1. A drying unit comprising:

a drying chamber;

a heat pump cycle device having:

an evaporator having an inlet and an outlet, a radiator having an inlet and an outlet, a compressor disposed between the outlet of the evaporator and the inlet of the radiator, for compressing a refrigerant from the outlet of the evaporator, a pressure reducing/expansion valve that is disposed between the outlet of the radiator and the inlet of the evaporator, a pressure reducing/expansion device that is disposed between the outlet of the radiator and the pressure reducing/expansion valve, a first opening/closing valve that is disposed between the outlet of the radiator and the pressure reducing/expansion valve in parallel with the pressure reducing/expansion device, an auxiliary heat exchanger that is disposed between and in series with the pressure reducing/expansion device and the pressure reducing/expansion valve, and a refrigerant passing means having a second opening/closing valve or a change-over valve and that is disposed between the outlet of the radiator and the pressure reduction/expansion valve and that alters a plurality of refrigerant paths from the outlet of the radiator to the pressure reducing/expansion valve;

an air circulation path for allowing air to be circulated by a blower in such a manner that air heated by said radiator is introduced into the drying chamber to dry an object to be dried in said drying chamber, exhaust air discharged from said drying chamber is dehumidified in said evaporator and is re-heated by said radiator;

an external heat source applying device that is structured and arranged so that refrigerant passing through said auxiliary heat exchanger is heat-exchanged with an external heat source so as to quicken the rise in temperature of the air by refrigerant evaporation in said auxiliary heat exchanger in an initial stage of a drying operation; and wherein the refrigerant passing means is structured and arranged to alter the plurality of refrigerant paths so that:

refrigerant traveling from said radiator to said evaporator via said pressure reducing/expansion valve travels through said pressure reducing/expansion device and said auxiliary heat exchanger after leaving said radiator during the initial stage of the drying operation;

refrigerant traveling from said radiator to said evaporator via said pressure reducing/expansion valve travels through the refrigerant passing means, bypassing said pressure reducing/expansion device and said auxiliary heat exchanger during a middle stage of the drying operation; and during a later stage of the drying operation, refrigerant traveling from said radiator to said evaporator via said pressure reducing/expansion valve travels through said first opening/closing valve and said auxiliary heat exchanger, bypassing said pressure reducing/expansion device and said refrigerant passing means after leaving said radiator.

2. A drying unit according to claim 1, wherein said auxiliary heat exchanger is disposed within ambient air present outside said air circulation path, and a blower for forcibly heat-exchanging said auxiliary heat exchanger with ambient air is used as said external heat source applying device.

3. A laundry washing/drying machine comprising the drying unit described in claim 2, wherein the drying unit is adapted to cool the laundry by turning OFF said heat-pump cycle device and turning ON said blower immediately after termination of the drying operation.

4. A drying unit according to claim 1, wherein as said external heat source applying device there is used an antifreeze solution tank for heat exchange of the refrigerant passing through said auxiliary heat exchanger with an antifreeze solution stored in the tank.

5. A laundry washing/drying machine comprising the drying unit described in claim 4, wherein the drying unit is adapted to cool the laundry by turning OFF said heat-pump cycle device and turning ON said blower immediately after termination of the drying operation.

6. A laundry washing/drying machine comprising the drying unit described in claim 1, wherein the drying unit is adapted to cool the laundry by turning OFF said heat-pump cycle device and turning ON said blower immediately after termination of the drying operation.

7. In a laundry washing machine wherein a laundry drying chamber is formed within a rotary drum, and with rotation of said rotary drum, the laundry is washed, rinsed with rinsing water and spin-dried within said rotary drum, followed by a drying operation within said rotary drum, a drying unit comprising:

a water storage tank for storage of the rinsing water;

a heat pump cycle device having:

an evaporator having an inlet and an outlet, a radiator having an inlet and an outlet, a compressor disposed between the outlet of the evaporator and the inlet of the radiator, for compressing a refrigerant from the outlet of the evaporator, a pressure reducing/expansion valve that is disposed between the outlet of the radiator of the inlet of the evaporator, a pressure reducing/expansion device that is disposed between the outlet of the radiator and the pressure reducing/expansion valve, a first opening/closing valve that is disposed between the outlet of the radiator and the pressure reducing/expansion valve in parallel with the pressure reducing/expansion device, an auxiliary heat exchanger that is disposed between and in series with the pressure reducing/expansion device and the pressure reducing/expansion valve, and a refrigerant passing means that includes a first opening/closing valve or a change-over valve and that is disposed between the outlet of the radiator and the pressure reducing/expansion valve and that alters a plurality of refrigerant paths from the outlet of the radiator to the pressure reducing/expansion valve;

an air circulation path allowing air to be circulated by a blower in such a manner that air heated by said radiator is introduced into said rotary drum to dry the laundry, exhaust air discharged from said rotary drum is passed through said evaporator, then is heated again by said radiator and the air thus dehumidified is circulated by said blower, said auxiliary heat exchanger being constructed so as to be heat-exchanged with the water stored in said water storage tank in order to quicken the rise in temperature of the air by refrigerant evaporation in said auxiliary heat exchanger in an initial stage of the drying operation; and wherein the refrigerant passing means is structured and arranged to alter the plurality of refrigerant paths so that:

refrigerant traveling from said radiator to said evaporator via said pressure reducing/expansion valve travels through said pressure reducing/expansion device and said auxiliary heat exchanger after leaving said radiator during the initial stage of the drying operation refrigerant traveling from said radiator to said evaporator via said pressure reducing/expansion valve bypasses said pressure reducing/expansion device and said auxiliary heat exchanger after leaving said radiator during a middle stage of the drying operation; and during a later stage of the drying operation, refrigerant traveling from said radiator to said evaporator via said pressure reducing/expansion valve travels through said first opening/closing valve and said auxiliary heat exchanger, bypassing said pressure reducing/expansion device and said refrigerant passing means after leaving said radiator.

8. A laundry washing/drying machine comprising the drying unit described in claim 7, wherein the drying unit is adapted to cool the laundry by turning OFF said heat-pump cycle device and turning ON said blower immediately after termination of the drying operation.

9. In a laundry machine wherein a laundry drying chamber is formed within a rotary drum, and with rotation of said rotary drum, the laundry is washed, rinsed with rinsing water and spin-dried within said rotary drum, followed by a drying operation within said rotary drum, a drying unit comprising:

a water storage tank for storage of the rinsing water;

a heat pump cycle device having:

an evaporator having an inlet and an outlet, a radiator having an inlet and an outlet, a compressor disposed between the outlet of the evaporator and the inlet of the radiator, for compressing a refrigerant from the outlet of the evaporator, a pressure reducing/expansion valve that is disposed between the outlet of the radiator and the inlet of the evaporator, a first opening/closing valve that is disposed between the outlet of the radiator and the pressure reducing/expansion valve in parallel with the pressure reducing/expansion device, an auxiliary heat exchanger that is disposed between and in series with the pressure reducing/expansion device and the pressure reducing/expansion valve, and a refrigerant passing means that includes a second opening/closing valve or a change-over valve and that is disposed between the outlet of the radiator and the pressure reducing/expansion valve and that alters a plurality of refrigerant paths from the outlet of the radiator to the pressure reducing/expansion valve;

an air circulation path allowing air to be circulated by a blower in such a manner that air heated by said radiator is introduced into said drying chamber to dry the laundry, exhaust air discharged from said drying chamber is passed through said evaporator, then is heated again by said radiator and the air thus dehumidified is circulated by said blower, wherein the refrigerant passing means is structured and arranged to alter the plurality of refrigerant paths so as to quicken the rise in temperature of the air by refrigerant evaporation in said auxiliary heat exchanger by heat-exchanging with the water stored in said water storage tank in an initial stage of the drying operation, and so as to heat the water stored in said water storage tank by radiating heat in said auxiliary heat exchanger by passing a substantial pressure reducing and expanding action induced by said pressure reducing/expansion device by bypassing the pressure reducing/expansion device during a later stage of the drying operation.

10. A laundry washing/drying machine comprising the drying unit described in claim 9, wherein the drying unit is adapted to cool the laundry by turning OFF said heat-pump cycle device and turning ON said blower immediately after termination of the drying operation.

11. A drying unit comprising:

a drying chamber;

a heat pump cycle device having:

an evaporator having an inlet and an outlet, a radiator having an inlet and an outlet, a compressor disposed between the outlet of the evaporator and the inlet of the radiator, for compressing a refrigerant from the outlet of the evaporator, a first pressure reducing/expansion valve that is disposed between the outlet of the radiator and the inlet of the evaporator, a second pressure reducing/expansion valve that is disposed between the outlet of the radiator and the first pressure reducing/expansion valve, an auxiliary heat exchanger that is disposed between and in series with the first pressure reducing/expansion valve and the second pressure reducing/expansion valve, and a refrigerant passing means having an opening/closing valve or a change-over valve and that is disposed between the outlet of the radiator and the first pressure reduction/expansion valve and that alters a plurality of refrigerant paths from the outlet of the radiator to the first pressure reducing/expansion valve;

an air circulation path for allowing air to be circulated by a blower in such a manner that air heated by said radiator is introduced into the drying chamber to dry an object to be dried in said drying chamber, exhaust air discharged from said drying chamber is dehumidified in said evaporator and is re-heated by said radiator;

an external heat source applying device that is structured and arranged so that refrigerant passing through said auxiliary heat exchanger is heat-exchanged with an external heat source so as to quicken the rise in temperature of the air by refrigerant evaporation in said auxiliary heat exchanger in an initial stage of a drying operation; and wherein the refrigerant passing means is structured and arranged to alter the plurality of refrigerant paths so that:

refrigerant traveling from said radiator to said evaporator via said first pressure reducing/expansion valve travels through said second pressure reducing/expansion valve and said auxiliary heat exchanger after leaving said radiator during the initial stage of the drying operation;

refrigerant traveling from said radiator to said evaporator via said first pressure reducing/expansion valve bypasses said second pressure reducing/expansion valve and said auxiliary heat exchanger during a middle stage of the drying operation; and during a later stage of the drying operation, refrigerant traveling from said radiator to said evaporator via said first pressure reducing/expansion valve after leaving said radiator, travels through said second pressure reducing/expansion valve without said second pressure reducing/expansion valve expanding, pressure reducing or throttling the refrigerant.

12. In a laundry washing machine wherein a laundry drying chamber is formed within a rotary drum, and with rotation of said rotary drum, the laundry is washed, rinsed with rinsing water and spin-dried within said rotary drum, followed by a drying operation within said rotary drum, a drying unit comprising:

a water storage tank for storage of the rinsing water;

a heat pump cycle device having:

an evaporator having an inlet and an outlet, a radiator having an inlet and an outlet, a compressor disposed between the outlet of the evaporator and the inlet of the radiator, for compressing a refrigerant from the outlet of the evaporator, a first pressure reducing/expansion valve that is disposed between the outlet of the radiator of the inlet of the evaporator, a second pressure reducing/expansion valve that is disposed between the outlet of the radiator and the first pressure reducing/expansion valve, an auxiliary heat exchanger that is disposed between and in series with the first pressure reducing/expansion valve and the second pressure reducing/expansion valve, and a refrigerant passing means that includes an opening/closing valve or a change-over valve and that is disposed between the outlet of the radiator and the first pressure reducing/expansion valve and that alters a plurality of refrigerant paths from the outlet of the radiator to the first pressure reducing/expansion valve;

an air circulation path allowing air to be circulated by a blower in such a manner that air heated by said radiator is introduced into said rotary drum to dry the laundry, exhaust air discharged from said rotary drum is passed through said evaporator, then is heated again by said radiator and the air thus dehumidified is circulated by said blower, said auxiliary heat exchanger being constructed so as to be heat-exchanged with the water stored in said water storage tank in order to quicken the rise in temperature of the air by refrigerant evaporation in said auxiliary heat exchanger in an initial stage of the drying operation; and wherein the refrigerant passing means is structured and arranged to alter the plurality of refrigerant paths so that:

refrigerant traveling from said radiator to said evaporator via said first pressure reducing/expansion valve travels through said second pressure reducing/expansion valve and said auxiliary heat exchanger after leaving said radiator during the initial stage of the drying operation refrigerant traveling from said radiator to said evaporator via said first pressure reducing/expansion valve bypasses said second pressure reducing/expansion valve and said auxiliary heat exchanger after leaving said radiator during a middle stage of the drying operation; and during a later stage of the drying operation, refrigerant traveling from said radiator to said evaporator via said first pressure reducing/expansion valve after leaving said radiator travels through said second pressure reducing/expansion valve without said second pressure reducing/expansion valve expanding, pressure reducing or throttling the refrigerant.

* * * * *

UNITED STATES PATENT AND TRADEMARK OFFICE

CERTIFICATE OF CORRECTION

PATENT NO. : 8,347,520 B2
APPLICATION NO. : 12/079750
DATED : January 8, 2013
INVENTOR(S) : Osamu Kuwabara It is certified that error appears in the above-identified patent and that said Letters Patent is hereby corrected as shown below:

In the Claims

Column 26, Claim 9, between lines 27 and 28, add the following paragraph:

--a pressure reducing/expansion device that is disposed between the outlet of the radiator and the pressure reducing/expansion valve,--.

Signed and Sealed this
Twenty-sixth Day of August, 2014

Michelle K. Lee

Michelle K. Lee
*Deputy Director of the United States Patent and Trademark Office*